US007527349B2

(12) United States Patent
Jung et al.

(10) Patent No.: US 7,527,349 B2
(45) Date of Patent: May 5, 2009

(54) INKJET IMAGE FORMING APPARATUS AND METHOD OF MAINTAINING NOZZLE UNIT THEREOF

(75) Inventors: Youn-gun Jung, Gunpo-si (KR); Heon-soo Park, Seongnam-si (KR); Jin-ho Park, Yongin-si (KR); Sung-wook Kang, Seoul (KR); Dong-woo Ha, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 245 days.

(21) Appl. No.: 11/485,473

(22) Filed: Jul. 13, 2006

(65) Prior Publication Data

US 2007/0040864 A1 Feb. 22, 2007

(30) Foreign Application Priority Data

Aug. 19, 2005 (KR) ..... 10-2005-0076370

(51) Int. Cl.
*B41J 2/165* (2006.01)

(52) U.S. Cl. ..... 347/33; 347/29; 347/32

(58) Field of Classification Search ..... 347/29, 347/30, 32, 33
See application file for complete search history.

(56) References Cited

U.S. PATENT DOCUMENTS

| | | | | |
|---|---|---|---|---|
| 5,760,802 | A | 6/1998 | Ebinuma et al. | |
| 5,971,520 | A * | 10/1999 | Nakahara | 347/30 |
| 6,578,945 | B2 * | 6/2003 | Hashi et al. | 347/22 |
| 6,582,072 | B1 | 6/2003 | Wotton et al. | |
| 6,637,856 | B2 | 10/2003 | Nishi et al. | |
| 7,198,350 | B2 * | 4/2007 | Nakashima | 347/23 |
| 2002/0044168 | A1 | 4/2002 | Hashi et al. | |
| 2005/0041059 | A1 | 2/2005 | Nakashima et al. | |
| 2006/0001696 | A1 | 1/2006 | Ha et al. | |
| 2006/0268049 | A1 | 11/2006 | Jung et al. | |

FOREIGN PATENT DOCUMENTS

| | | |
|---|---|---|
| CN | 1575992 | 2/2005 |
| DE | 3723954 | 4/1988 |
| EP | 1201436 | 5/2002 |
| EP | 1279507 | 1/2003 |
| EP | 1493584 | 1/2005 |
| JP | 5-42675 | 2/1993 |

(Continued)

OTHER PUBLICATIONS

Korean Office Action dated Apr. 18, 2007 issued in KR 2005-76370.

(Continued)

*Primary Examiner*—Shih-wen Hsieh
(74) *Attorney, Agent, or Firm*—Stanzione & Kim, LLP

(57) ABSTRACT

An inkjet image forming apparatus includes a cap member, a wiper, a nozzle unit, and a platen. The cap member and the wiper face the nozzle unit and are located at a position lower than an upper surface of the platen that constitutes a paper delivery path. The platen is moveable to a printing position constituting a paper delivery path and a maintenance position that leaves the printing position such that the wiper and the cap member can access the nozzle unit.

71 Claims, 19 Drawing Sheets

FOREIGN PATENT DOCUMENTS

| | | | | | |
|---|---|---|---|---|---|
| JP | 5-162320 | | 6/1993 | | |
| JP | 406079875 | A | * | 3/1994 | ..... 349/29 |
| JP | 7-164642 | | | 6/1995 | |
| JP | 2001-71521 | | | 3/2001 | |
| JP | 2001-277529 | | | 10/2001 | |
| JP | 2004/074554 | | | 3/2004 | |
| KR | 2003-40029 | | | 5/2003 | |
| WO | WO 2005/002859 | | | 1/2005 | |

OTHER PUBLICATIONS

Extended European Search Report dated Oct. 5, 2007 issued in EP 06119160.7.

Chinese Office Action dated Aug. 29, 2008 issued in CN 2006-10115541.4.

* cited by examiner

INKJET IMAGE FORMING APPARATUS AND METHOD OF MAINTAINING NOZZLE UNIT THEREOF

CROSS-REFERENCE TO RELATED APPLICATIONS

This application claims priority under 35 U.S.C. §119(a) from Korean Patent Application No. 10-2005-0076370, filed on Aug. 19, 2005, in the Korean Intellectual Property Office, the disclosure of which is incorporated herein in its entirety by reference.

BACKGROUND OF THE INVENTION

1. Field of the Invention

The present general inventive concept relates to an inkjet image forming apparatus and a method of maintaining a nozzle unit, and more particularly, to an inkjet image forming apparatus having an array inkjet head and a method of maintaining a nozzle unit of the array inkjet head.

2. Description of the Related Art

An inkjet image forming apparatus is an apparatus to form an image by firing ink from an inkjet head that makes a reciprocating motion in a main scanning direction onto paper fed in a subsidiary scanning direction. The inkjet head has a nozzle unit on which a plurality of nozzles to fire the ink are formed. After printing, waste ink droplets remain around the nozzle unit, and can solidify or attract foreign substances, such as fine dust, from the air. The solidified ink or foreign substances change the firing direction of the ink and reduce printing quality. Also, ink in the nozzle unit is solidified and nozzles are blocked. To prevent such problems, maintenance operations need to be preformed, such as capping, which isolates the nozzle unit from outside air while not printing, and wiping, which eliminates foreign substances from the nozzle unit.

Recently, attempts have been made to achieve high-speed printing using an inkjet head called an array inkjet head, which includes a nozzle unit having a length in a main scanning direction that corresponds to a width of a paper, instead of a shuttle-type inkjet head. In such an inkjet image forming apparatus, only the paper is moved in the subsidiary scanning direction and the inkjet head is fixed. Therefore, a driving unit of the inkjet image forming apparatus is simplified and high-speed printing can be realized. In the inkjet image forming apparatus including the array inkjet head, a length of the nozzle unit may be about 210 mm so as to cover A4 paper, on the assumption that a printing margin in the width direction of paper is not considered. Since the array inkjet head fires ink at a fixed position, unlike the shuttle-type inkjet head that reciprocates in a main scanning direction, it is difficult to compensate for blocked nozzles or distortion of the firing direction. Therefore, an effective maintenance operation is required.

In an inkjet image forming apparatus disclosed in U.S. Pat. No. 6,637,856, a head cap and a cleaning roller are parallel to an inkjet head. A belt for delivering paper is located below the inkjet head. To perform a maintenance operation, the head cap and the cleaning roller are moved below the inkjet head. The belt is lowered from its original position to leave a space for the head cap and the cleaning roller.

In the inkjet image forming apparatus disclosed in U.S. Pat. No. 6,637,858, a printbar assembly is coupled to a fixed member by a hinge. A belt for delivering paper is located below the printbar assembly. To perform a capping operation and a wiping operation, the printbar assembly is pivoted on the hinge, away from the belt. A wiper assembly is moved between the belt and the printbar assembly. The wiper assembly is moved in a width direction of a paper to wipe the bottom of the printbar. After that, the printhead cap caps the printbar assembly.

SUMMARY OF THE INVENTION

The present general inventive concept provides an inkjet image forming apparatus having an array inkjet head and a method of maintaining a nozzle unit capable of performing a maintenance operation without moving a delivering unit to deliver a printing medium (e.g., paper).

The present general inventive concept also provides a compact inkjet image forming apparatus having an array inkjet head.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an inkjet image forming apparatus including an inkjet head including a nozzle unit having a length equal to or greater than a width of a printing medium, a platen facing the nozzle unit to support a backside of the printing medium, to form a delivery path with the nozzle unit, and to be moveable between a printing position and a maintenance position, a wiper to wipe the nozzle unit, and a cap member to cap the nozzle unit, in which the printing position constitutes the delivery path, and the maintenance position is spaced apart from the printing position such that when the wiper and the cap member access the nozzle unit, the platen is located at an opposite side of the nozzle unit with respect to the delivery path.

The platen may be located between the nozzle unit and at least one of the cap member and the wiper when the platen is positioned in the printing position.

A movement path of the platen between the printing position and the maintenance position may be substantially parallel to the delivery path.

The apparatus may further include a delivery unit located at an entry side of the nozzle unit to deliver paper the printing medium to below the nozzle unit, and a discharge unit located at an exit side of the nozzle unit to discharge printed printing medium, and the platen may be moveable toward the discharge unit may be positioned in the maintenance position.

The platen may have a concave groove to prevent an interference of the platen with the discharge unit when the platen is positioned in the maintenance position.

A movement path of the platen between the printing position and the maintenance position may include a parallel interval that is substantially parallel to the delivery path in which a gap between the platen and the nozzle unit remains constant and a sloped interval in which the gap between the platen and the nozzle unit changes.

The apparatus may further include a delivery unit located at an entry side of the nozzle unit to deliver the printing medium to below the nozzle unit, and a discharge unit located at an exit side of the nozzle unit to discharge printed printing medium, and the platen may be positioned below the discharge unit when the platen is positioned in the maintenance position.

The wiper may be connected to and moveable with the platen to wipe the nozzle unit while the platen moves between the printing position and the maintenance position.

The wiper may wipe the nozzle unit during at least one of a time period in which the platen moves from the printing position to the maintenance position and a time period in which the platen moves from the maintenance position to the printing position.

The apparatus may further include a first reference part in the cap member; and a second reference part in the nozzle unit to be coupled with the first reference part when the nozzle unit is capped.

The platen may have receiving parts recessed from an upper surface of the platen facing the nozzle unit to receive ink spitted by the nozzle unit.

The nozzle unit may have nozzle plates arranged in a zigzag pattern in a width direction of the printing medium, and the receiving parts of the platen are arranged in a zigzag pattern to correspond to the zigzag pattern of the nozzle plates.

The apparatus may further include a driving source to drive the platen, the wiper, and the cap member.

The apparatus may further include a first driving source to drive the platen and the wiper, and a second driving source to drive the cap member, and the first and second driving sources may be independent of each other.

The foregoing and/or other aspects and utilities of the present general inventive concept may also be achieved by providing an inkjet image forming apparatus including an inkjet head including a nozzle unit having a length equal to or greater than a width of a printing medium, a platen facing the nozzle unit to support the backside of the printing medium to form a delivery path, the platen being moveable between a printing position and a maintenance position, a wiper to wipe the nozzle unit, a cap member to cap the nozzle unit, and a delivery unit located at an entry side of the nozzle unit to deliver the printing medium to the delivery path, in which the printing position constituting the delivery path and the maintenance position is spaced apart from the printing position such that when the wiper and the cap member can each access the nozzle unit, the delivery unit remains at a fixed position with respect to the nozzle unit.

The apparatus may further include a discharge unit fixedly-located at an exit side of the nozzle unit to discharge printed printing medium and having a fixed position.

The foregoing and/or other aspects and utilities of the present general inventive concept may also be achieved by providing an inkjet head including a nozzle unit having a length equal to or greater than a width of a printing medium, and a first reference part, and a cap member to cap the nozzle unit, the cap member including a second reference part to correspond to the first reference part of the inkjet head, in which the first reference part is to be coupled with the second reference part to cap the nozzle unit.

The second reference part may be a protuberance protruding from the cap member, and the first reference part may be recessed from a lower surface of the nozzle unit to receive the protuberance when the nozzle unit is capped.

The apparatus may further include a platen facing the nozzle unitto form a delivery path with the nozzle unit and to support a backside of paper, and the platen may move between a printing position constituting the delivery path and a maintenance position spaced apart from the printing position such that when the platen is positioned at the maintenance position, the cap member accesses the nozzle unit The foregoing and/or other aspects and utilities of the present general inventive concept may also be achieved by providing an inkjet image forming apparatus including an inkjet head including a nozzle unit having a length equal to or greater than a width of a printing medium, a wiper to wipe the nozzle unit, and a platen facing the nozzle unit to support a backside of the printing medium to form a delivery path, the platen being moveable between a printing position constituting the delivery path and a maintenance position at an opposite side of the nozzle unit with respect to the delivery path to allow the wiper to access the nozzle unit.

The foregoing and/or other aspects and utilities of the present general inventive concept may also be achieved by providing an inkjet image forming apparatus including, an inkjet head including a nozzle unit having a length equal to or greater than a width of a printing medium, a cap member to cap the nozzle unit, and a platen facing the nozzle unit to support a backside of the printing medium to form a delivery path, the platen being moveable between a printing position constituting the delivery path and a maintenance position at an opposite side of the nozzle unit with respect to the delivery path to allow the cap member to access the nozzle unit.

The foregoing and/or other aspects and utilities of the present general inventive concept may also be achieved by providing a method of maintaining a nozzle unit of an inkjet image forming apparatus, the apparatus having an inkjet head including a nozzle unit having a length equal to or greater than a width of a printing medium, a platen facing the nozzle unit to support a backside of the printing medium to form a delivery path, a wiper to wipe the nozzle unit, and a cap member to cap the nozzle unit, the method including moving the platen from a printing position forming the paper delivery path to a maintenance position to expose a lower portion of the nozzle unit to allow a wiping and a capping of the nozzle unit, moving the wiper and the cap member from original positions thereof to wipe and cap the nozzle unit, and returning the wiper and the cap member to the original positions thereof to allow printing, and moving the platen between the nozzle unit and at least one of the cap member and the wiper to position the platen at the printing position.

The foregoing and/or other aspects and utilities of the present general inventive concept may also be achieved by providing an inkjet image forming apparatus, including an inkjet head unit, a platen moveable between a printing position to form a delivery path of a printing medium with the inkjet head unit and a non-printing position away from the printing position, and a maintenance unit having at least one of a wiper and a cap member to move between a rest position disposed opposite to the delivery path with respect to the printing position and a maintenance position corresponding to the printing position.

When the platen is disposed in the printing position, the maintenance unit may be disposed in the rest position opposite to the inkjet head unit with respect to the printing position of the platen. When the platen is disposed in the non-printing position, one of the wiper and the cap member may be disposed in the maintenance position and the other one of the wiper and the cap member may be disposed in the rest position. The apparatus may further include a driving unit to move the platen and the maintenance unit.

The apparatus may further include a driving unit, a first arm connected to the driving unit to move the platen and one of the wiper and the cap member, and a second arm connected to the driving unit to move the other one of the wiper and the cap member. The apparatus may further include a housing having a groove, the driving unit, a first arm connected to the driving unit and the groove to move one of the wiper and the cap member, and a second arm connected to the driving unit to move the other one of the wiper and the cap member. The apparatus may further include a housing having a first groove and a second groove, the driving unit, a first arm connected to the driving unit and the first groove to move the platen and one of the wiper and the cap member, and a second arm connected to the driving unit and the second groove to move the other one of the wiper and the cap member.

The platen may move in a direction substantially parallel to the delivery path, and the at least one of the wiper and the cap member may rotate between the maintenance position and the rest position with respect to a rotation axis disposed between the maintenance position and the rest position. The at least one of the wiper and the cap member may move with respect to the platen when the platen moves between the printing position and the non-printing position. The platen may move in a direction having an angle with the delivery path of the printing medium, and the at least one of the wiper and the cap member may rotate in a direction with respect to the platen.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
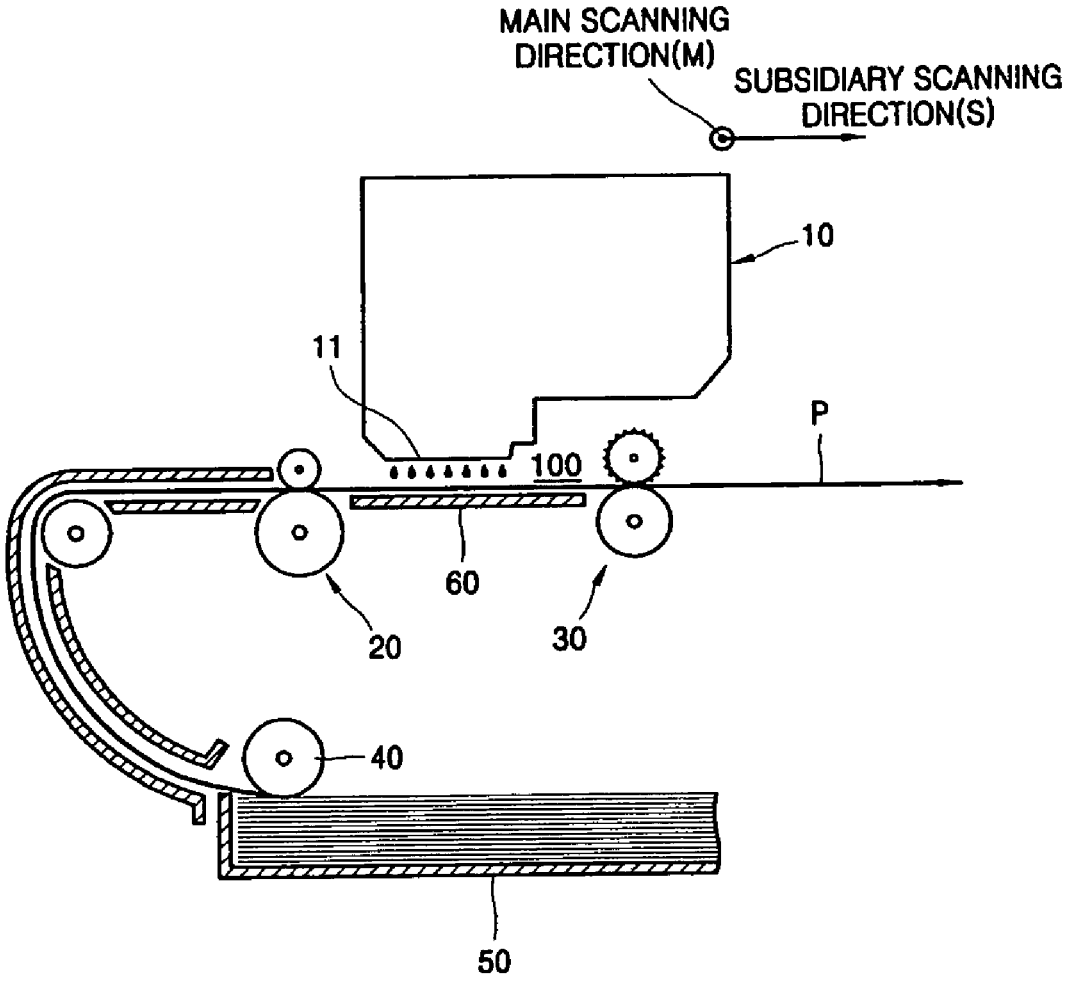
FIG. 1 is a view illustrating an inkjet image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a view illustrating an inkjet image forming apparatus according to an embodiment of the present general inventive concept. Referring to FIG. 1, a printing medium, such as a paper P, is picked up from a paper-feed cassette 50 by a pick-up roller 40 and is delivered in a subsidiary scanning direction (S) by a delivery unit 20. An inkjet head 10 is installed in a fixed position above the paper P and prints an image onto the paper P by firing ink onto the paper P.

Figure 2:
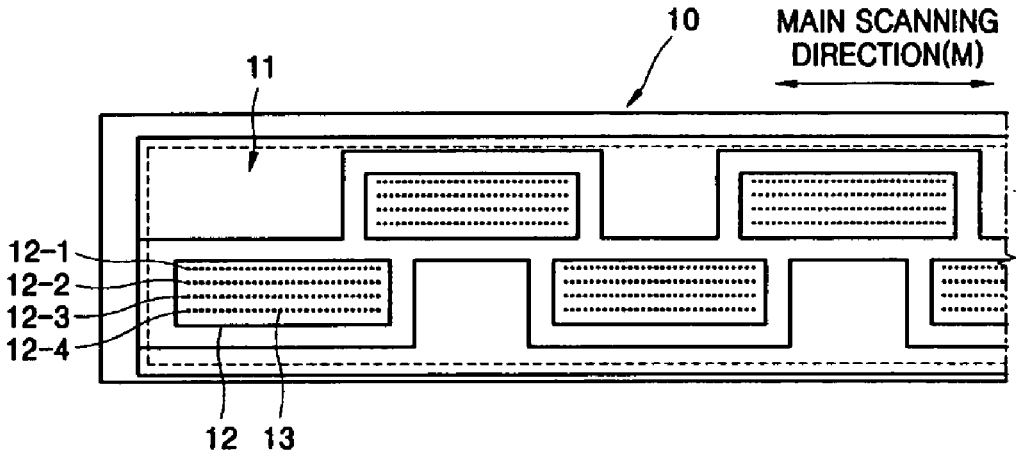
FIG. 2 is an exemplary view illustrating a nozzle unit of an inkjet head of the image forming apparatus of FIG. 1.

The inkjet head 10 of the present embodiment is an array inkjet head having a nozzle unit 11 of a length in a main scanning direction (M) at least equal to a width of the paper P. FIG. 2 is an exemplary view illustrating the nozzle unit 11 of FIG. 1. Referring to FIG. 2, the nozzle unit 11 has a plurality of nozzle plates 12 arranged in a zigzag pattern in the main scanning direction (M). Each nozzle plate 12 has a plurality of nozzles 13 to fire ink. Each nozzle plate 12 can have a plurality of nozzle rows 12-1, 12-2, 12-3, and 12-4. Respective nozzle rows 12-1, 12-2, 12-3, and 12-4 can fire ink of the same color or of different colors (e.g. cyan, magenta, yellow, and black), respectively. FIG. 2 illustrates only one example of the nozzle unit 11, and the scope of the present general inventive concept is not limited to the nozzle unit 11 of FIG. 2. Though not illustrated in FIGS. 1 and 2, the inkjet head 10 has a chamber communicating with the nozzles 13 and containing a firing unit (e.g. a piezo element or a heater) that provides a force to fire ink, and a channel to supply the ink to the chamber. Since the chamber, the firing unit, and the channel are well known to those skilled in the art, a detailed descriptions thereof will be omitted.

A platen 60 is located to face the nozzle unit 11 and to support a backside of the paper P, constituting a paper delivery path 100. The platen 60 is located such that the nozzle unit 11 of the inkjet head 10 maintains a predetermined distance (e.g. about 0.5 to about 2 mm) from the paper P. The inkjet head 10 has a discharge unit 30 installed at an exit side thereof to discharge the printed paper P.

When the nozzle unit 11 is exposed to air while not printing, ink droplets around the nozzle unit 11 can solidify and attract foreign substances, such as fine dusts, from the air. The solidified ink or the foreign substances can change a firing direction of ink from the nozzle unit 11 and reduce a printing quality. Also, the ink in the nozzle unit 11 evaporates constantly, and the nozzles 13 may be blocked by the solidified ink. Since the inkjet head 10 prints an image from a fixed position, a white line may be formed in the printed image when any of the nozzles 13 are blocked.

To achieve excellent printing quality, the nozzle unit 11 should be maintained at an optimum printing state. For that purpose, maintenance operations, such as spitting, wiping, and capping, may be performed. If printing is not performed for a period of time or if a nozzle 13 is not used for a period of time during printing using other nozzles 13, the not-used nozzle 13 and the ink around the not-used nozzle 13 become dry, which increases a viscosity of the ink which can cause a firing malfunction. The spitting involves firing ink several times over a period of time to eliminate ink whose viscosity has increased. The wiping involves rubbing a surface of the nozzle unit 11 to eliminate the solidified ink and foreign substances from around the nozzle 13. The capping involves covering the nozzle unit 11 when printing is not performed to cut off outside air and to prevent the nozzle 13 from drying.

Figure 3:
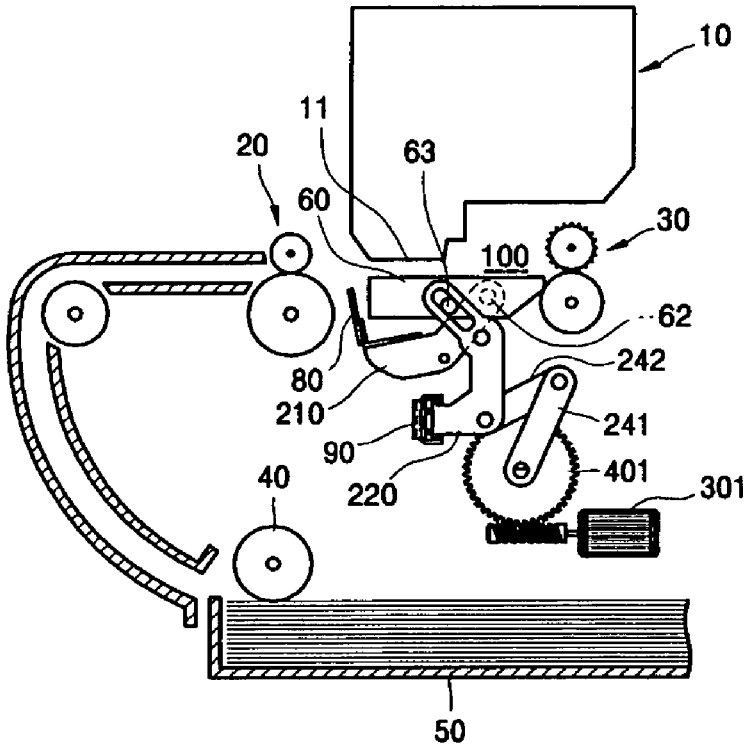
FIG. 3 is a view illustrating a maintenance device of the image forming apparatus of FIG. 1 according to an embodiment of the present general inventive concept.
Figure 11:
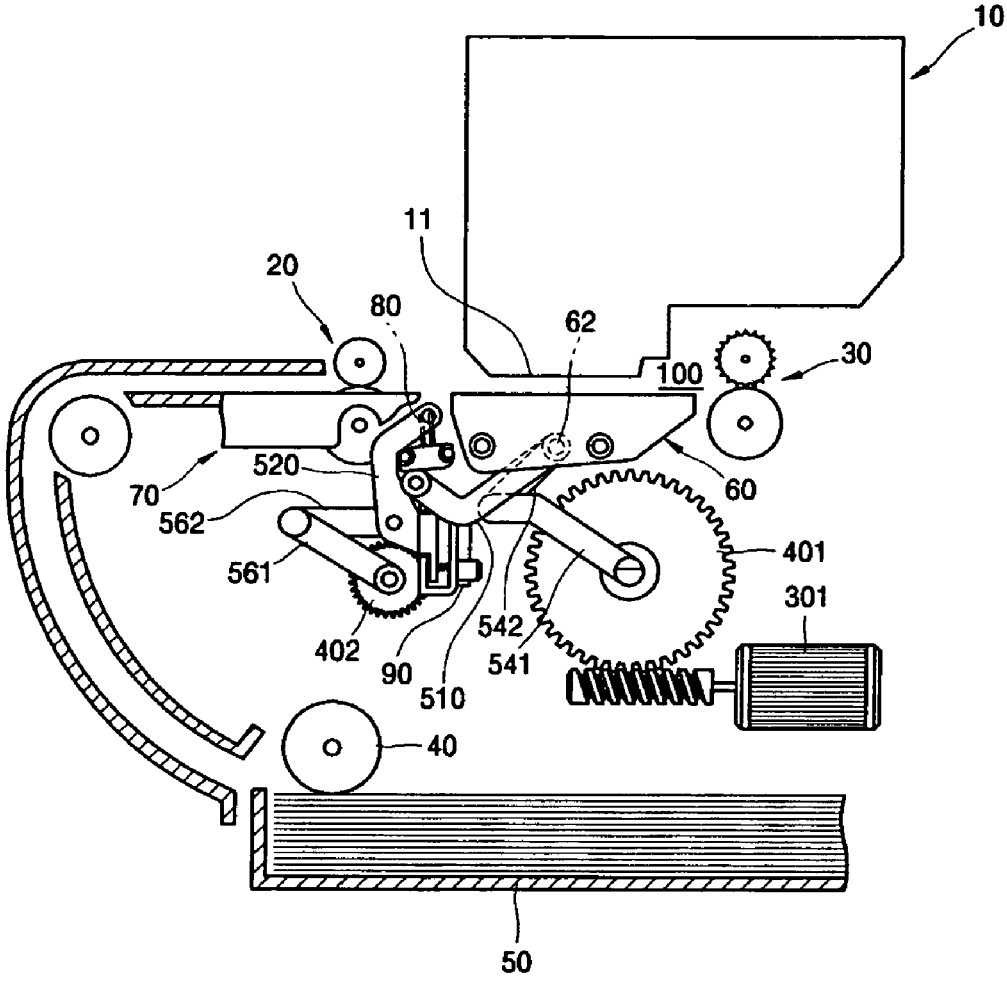
FIG. 11 is a view illustrating a maintenance device of the image forming apparatus of FIG. 1 according to another embodiment of the present general inventive concept.
Figure 16:
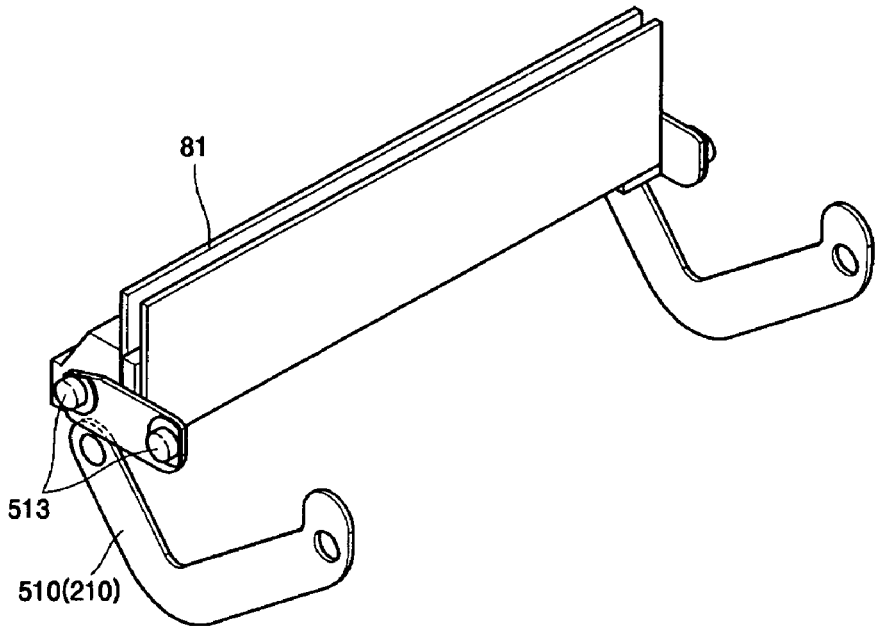
FIG. 16 is an exemplary perspective view illustrating a wiper according to an embodiment of the present general inventive concept.
Figure 17:
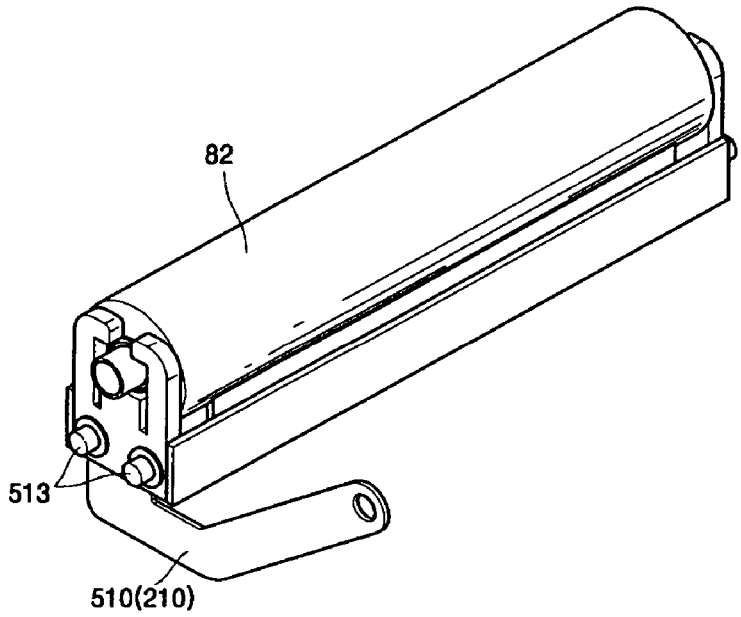
FIG. 17 is an exemplary perspective view illustrating a wiper according to another embodiment of the present general inventive concept.

For maintenance, the inkjet image forming apparatus includes a maintenance device having a cap member 90 to cap the nozzle unit 11, and a wiper 80 to wipe the nozzle unit 11, as illustrated in FIGS. 3 and 11. The wiper 80 may be, for example, a blade 81 or a roller 82 having elasticity as illustrated in FIGS. 16 and 17. The image forming apparatus of the present embodiment is characterized in that the cap member 90 and the wiper 80 are located at a position lower than an upper surface of the platen 60 during printing. Also, in the image forming apparatus of the present embodiment, the platen 60 is moveable between a printing position (refer to FIGS. 3 and 11) to constitute a paper delivery path 100, and a maintenance position (refer to FIGS. 8-9 and 18-21) to expose a lower portion of the nozzle unit 11 such that the wiper 80 and the cap member 90 can access the nozzle unit 11. Units (e.g. the delivery unit 20 and the discharge unit 30) to deliver the paper P are not moved when the platen 60 moves between the printing position and the maintenance position. At the maintenance position, the platen 60 is positioned opposite to the nozzle unit 11 with respect to the paper delivery path 100. At the maintenance position, a distance between the platen 60 and the nozzle unit 11 may be equal to or greater than a distance between the platen 60 and the nozzle unit 11 at the printing position. That is, the platen 60 may be positioned below the paper delivery path 100 at the maintenance position. With such a configuration, the platen 60 does not contact the nozzle unit 11 while the platen 60 moves.

A drive source to move the wiper 80 can also be a drive source to move the cap member 90, or the drive source to move the wiper 80 and the drive source to move the cap member 90 can be independent of each other. When a length of the subsidiary scanning direction (S) of the nozzle unit 11 increases, a movement distance of the wiper 80 increases. In that case, the two drive sources may be independent of each other, and the platen 60 and the wiper 80 can be driven by the same drive source, or the platen 60 and the cap member 90 can be driven by the same drive source.

Figure 4:
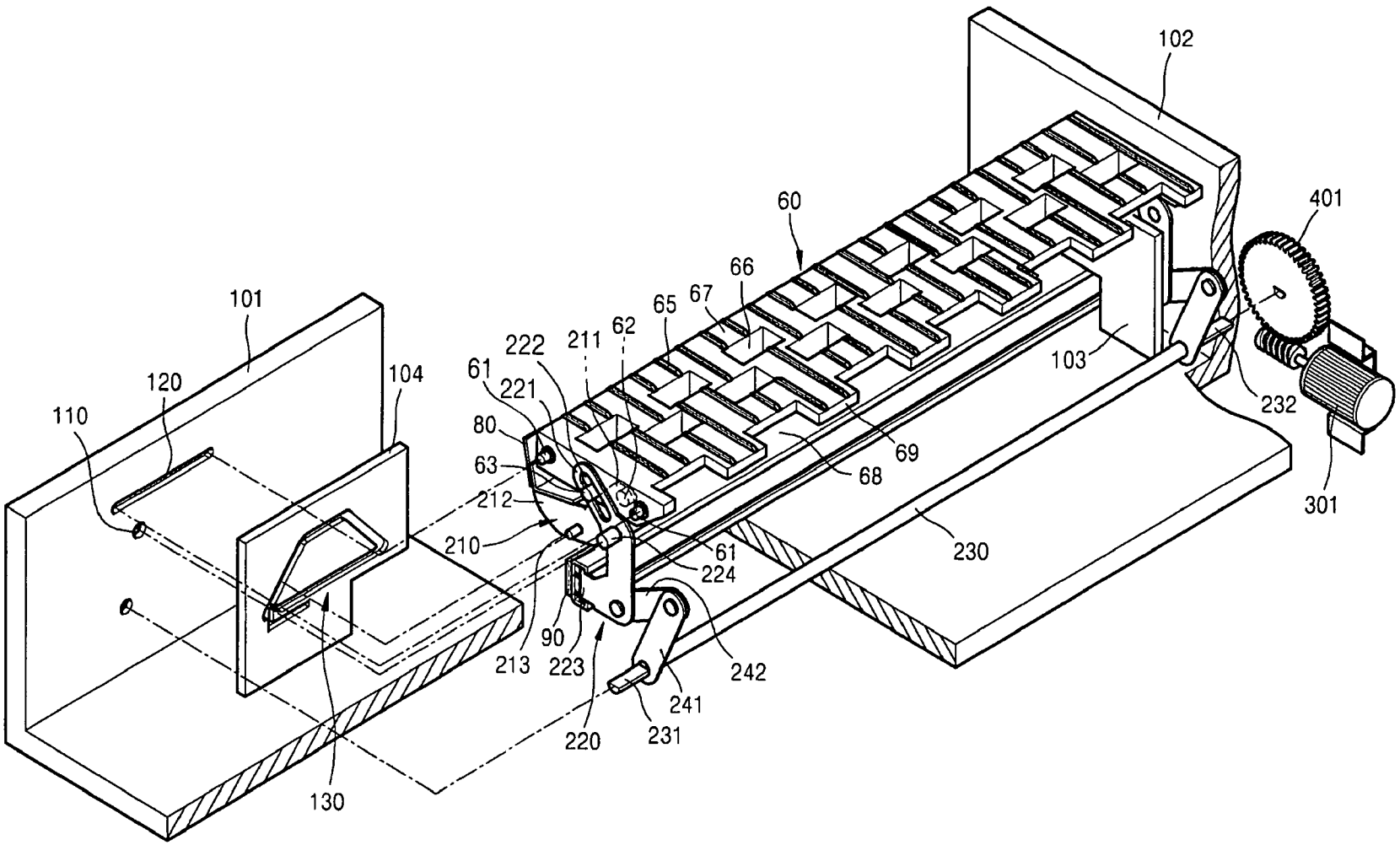
FIG. 4 is an exploded perspective view illustrating the maintenance device of FIG. 3 according to an embodiment of the present general inventive concept.
Figure 5:
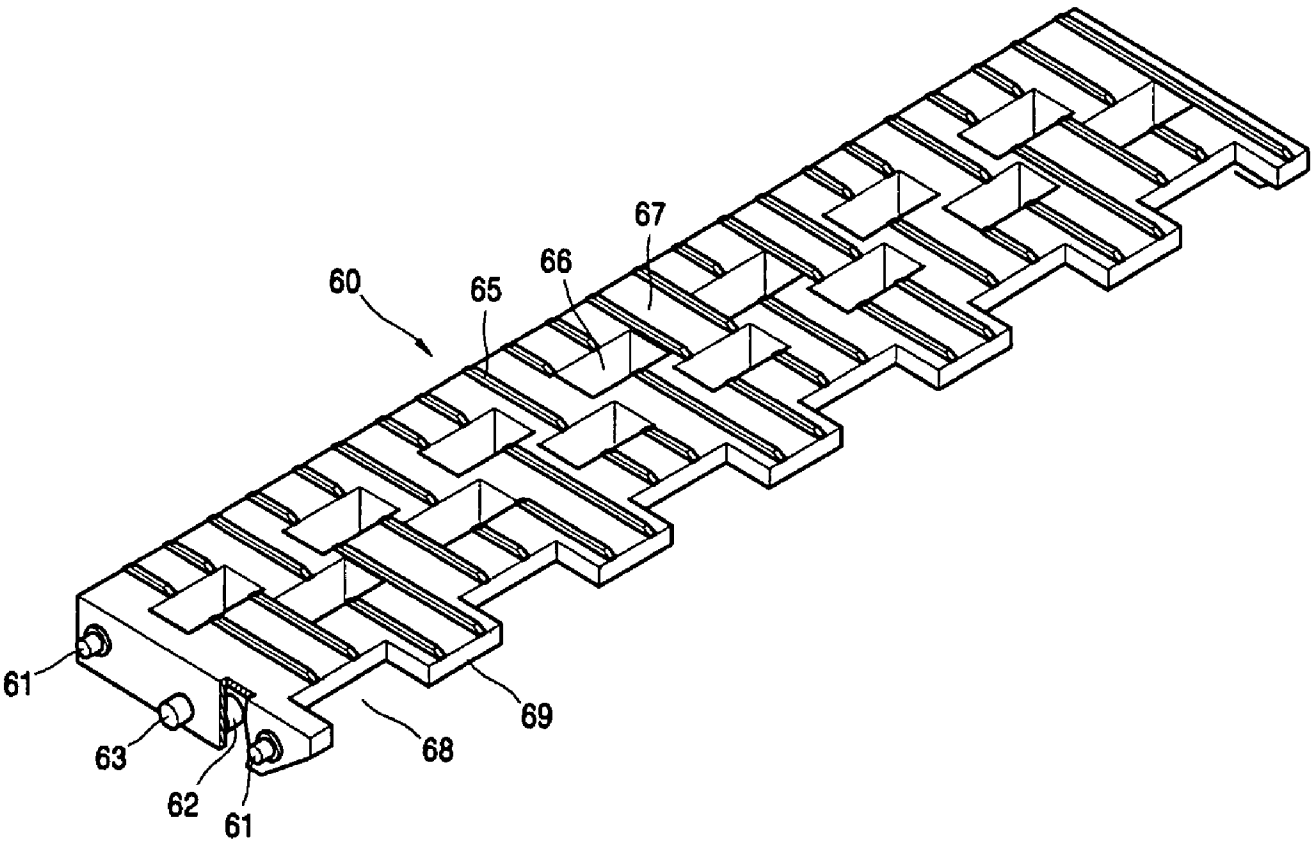
FIG. 5 is a detailed perspective view illustrating a platen of the maintenance device of FIG. 3 according to an embodiment of the present general inventive concept.
Figure 6:
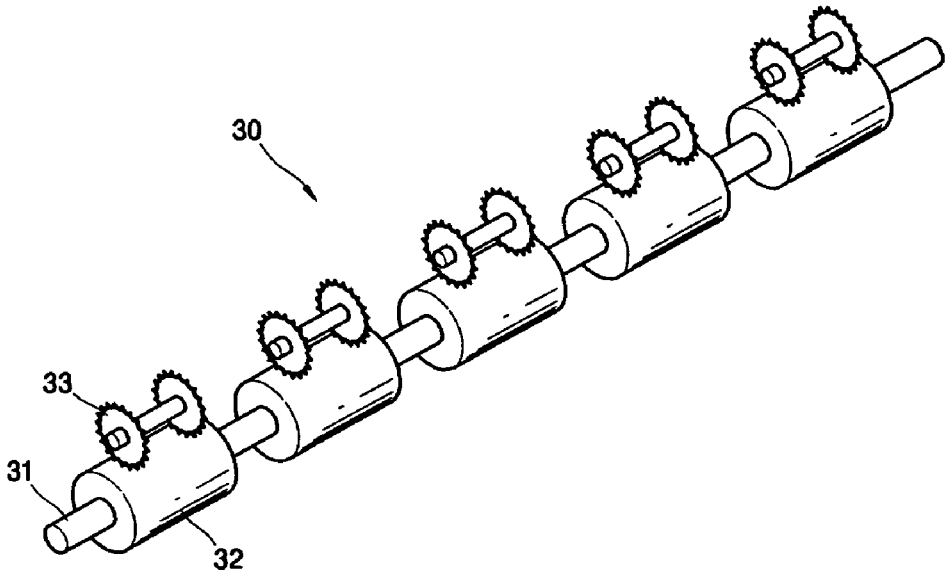
FIG. 6 is a detailed perspective view illustrating a discharge unit of the maintenance device of FIG. 3 according to an embodiment of the present general inventive concept.

FIG. 4 is an exploded perspective view illustrating the maintenance device of FIG. 3 according to an embodiment of the present general inventive concept. FIG. 5 is a detailed perspective view illustrating the platen 60 of the maintenance device of FIG. 3 according to an embodiment of the present general inventive concept. FIG. 6 is a detailed perspective view illustrating the discharge unit 30 of the maintenance device of FIG. 3 according to an embodiment of the present general inventive concept The maintenance device illustrated in FIG. 3 may be used when a movement path of the platen 60 is substantially parallel to the paper delivery path 100. Here, "substantially parallel" means that the platen 60 is not moved below the discharge unit 30, and therefore does not require a strictly parallel movement of the platen 60 with respect to the paper delivery path 100. Also, the maintenance device of the present embodiment may be used when a drive source to move the platen 60 and the wiper 80 also moves the cap member 90.

Referring to FIGS. 3, 4, and 5, a plurality of ribs 65 may be formed on an upper surface 67 of the platen 60 to support a backside of the paper P. The platen 60 may have receiving parts 66 formed on the upper surface 67 to receive ink spitted from the nozzle unit 11. The receiving parts 66 are located lower than the ribs 65 and may be formed such that the receiving parts 66 are recessed from the upper surface 67 of the platen 60. The platen 60 may have a plurality of receiving parts 66 to correspond to the arrangement of the nozzle plates 12 (illustrated in FIG. 2), and may also have a plurality of concave grooves 68.

Referring to FIGS. 3 and 6, the discharge unit 30 may have a discharge roller 31 and a plurality of star wheels 33. The discharge roller 31 may have a plurality of roller parts 32 arranged in the main scanning direction (M). The star wheels 33 may rotate by contacting the roller parts 32. The concave grooves 68 of the platen 60 illustrated in FIG. 5 may be formed to correspond to the roller parts 32. In this case, when the platen 60 is positioned at the maintenance position, the roller parts 32 are positioned in the corresponding concave grooves 68. Therefore, the platen 60 does not interfere with the discharge unit 30. Extension parts 69 formed between the concave grooves 68 function to guide the paper P up to the discharge unit 30 when the platen 60 is positioned at the printing position.

Referring to FIG. 4, a guide groove 120 may be formed in sidewalls 101 and 102. The guide groove 120 may be parallel with the paper delivery path 100. A protuberance 61 may be formed on both side portions of the platen 60. The protuberance 61 is inserted into the guide groove 120. The platen 60 moves to the printing position and the maintenance position along the guide groove 120.

Figure 7:
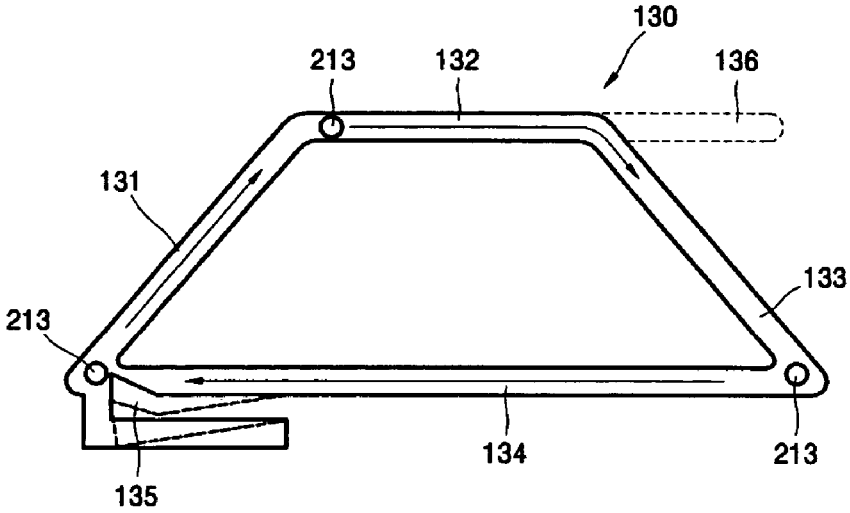
FIG. 7 is a detailed view illustrating a first cam trace of the maintenance device of FIG. 4 according to an embodiment of the present general inventive concept.

Referring to FIGS. 3 and 4, one end 211 of a first arm 210 is rotatably coupled to a hinge pole 62 formed in the platen 60, and the other end 212 is coupled to the wiper 80. FIG. 7 is a detailed view illustrating a first cam trace 130 of the maintenance device of FIG. 4 according to an embodiment of the present general inventive concept. Referring to FIGS. 4 and 7, the first cam trace 130 is formed in intermediate walls 103 and 104. A cam-follower 213 formed on a side portion of the first arm 210 is coupled to the first cam trace 130. The first cam trace 130 has a rotation interval 131 to rotate the first arm 210 such that the wiper 80 may contact the nozzle unit 11 when the platen 60 is moved from the printing position to the maintenance position, and a sustain interval 132 to maintain the wiper 80 in contact with the nozzle unit 11 or to control or move the wiper 80 to wipe the nozzle unit 11.

Also, the first cam trace 130 can further have a separating interval 133 to separate the wiper 80 from the nozzle unit 11. The first cam trace 130 can further have a returning interval 134 to guide the first arm 210 such that the wiper 80 does not contact the nozzle unit 11 when the platen 60 returns from the maintenance position to the printing position. In the case where the separating interval 133 is not included in the first cam trace 130, the sustain interval 132 extends up to an interval 136, illustrated as a dotted line in FIG. 7. An elastic arm 135 may function as a latch that allows the cam-follower 213 to move from the returning interval 134 to the rotation interval 131 but prevents the cam-follower 213 from moving from the rotation interval 131 to the returning interval 134. The elastic arm 135 may be formed between a portion of the returning interval 134 and a groove 135*a*, may form a narrow interval between the rotation interval 131 and an exit portion of the returning interval 134 to prevent the cam follower 213 from returning back to the returning interval 134, and may be widened by the cam follower 213 to enter from the returning interval 134 into the rotating interval 131.

Referring to FIGS. 3 and 4, a second arm 220 is rotatably coupled to sidewalls 101 and 102. A rotational shaft 224 of the second arm 220 is inserted into a hole 110 formed in the sidewalls 101 and 102. One end 221 of the second arm 220 is coupled to the platen 60, and the cap member 90 is installed at the other end 223 of the second arm 220. A long slot 222 is formed at the end 221. A guide shaft 63 formed in the side portion of the platen 60 is inserted into the slot 222. A shaft 230 is rotatably supported by the sidewalls 101 and 102. Chamfered portions 231 and 232 are formed at both ends of the shaft 230 to be supported by the sidewalls 101 and 102. A pair of first connecting arms 241 is coupled to the chamfered portions 231 and 232 of the shaft 230. A pair of second connecting arms 242 connects the pair of first connecting arms 241 to the second arm 220. A gear 401 is connected to the chamfered portion 232. A maintenance motor 301 rotates the gear 401.

Figure 8:
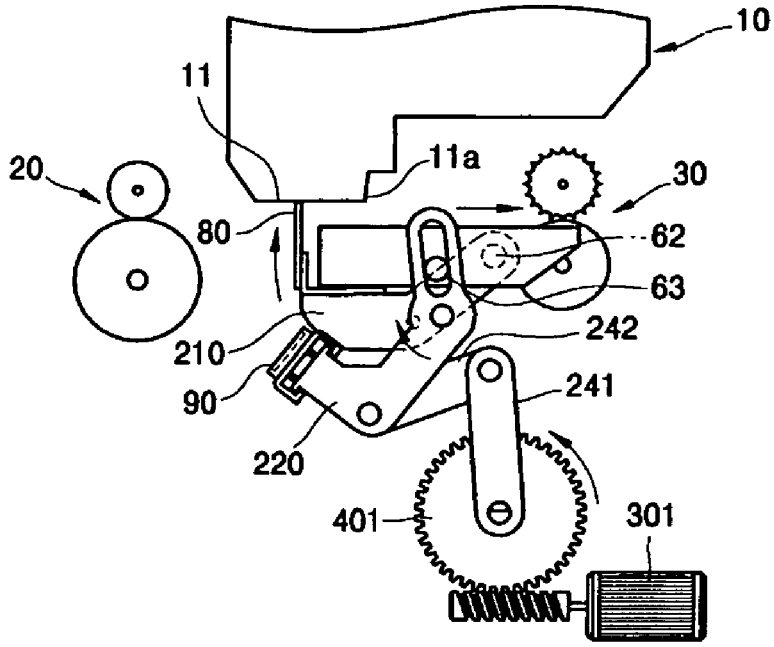
FIG. 8 is a view illustrating a wiping operation of the maintenance device of FIG. 3 according to an embodiment of the present general inventive concept.
Figure 9:
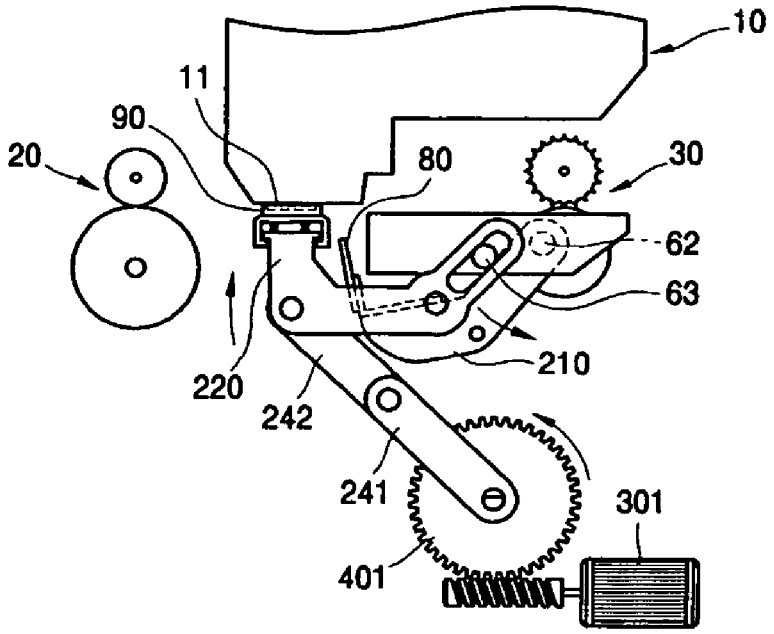
FIG. 9 is a view illustrating a capping operation of the maintenance device of FIG. 3 according to an embodiment of the present general inventive concept.

A maintenance operation for the above construction will now be described. FIG. 8 is a view illustrating a wiping operation of the maintenance device of FIG. 3 according to an embodiment of the present general inventive concept. FIG. 9 is a view illustrating a capping operation of the maintenance device of FIG. 3 according to an embodiment of the present general inventive concept.

Referring to FIGS. 3 and 4, the platen 60 is positioned at the printing position to support the backside of the paper P. The wiper 80 and the cap member 90 are positioned lower than the upper surface of the platen 60. In this state, the paper P is delivered through the paper delivery path 100 and ink is fired onto the paper P to print an image. Also, when no paper P exists in the paper delivery path 100 (e.g., before an image is printed or after printing several sheets of paper P) a spitting operation is performed. The receiving parts 66 of the platen 60 correspond to the plurality of nozzle plates 12 (see FIG. 2), and receive ink spitted from the nozzle unit 11. Since the receiving parts 66 are positioned lower than the upper surface of the platen 60 and the ribs 65 supporting the backside of the paper P, the backside of the paper P is not contaminated by the ink received in the receiving parts 66 even if the paper P is delivered after the spitting is performed. The spitting is performed before printing or after printing several sheets of paper P. According to the present embodiment, since the receiving parts 66 are formed in the platen 60, the spitting can be performed without moving the wiper 80, the cap member 90, and the platen 60. Therefore, a printing speed of the image forming apparatus can improve. The receiving parts 66 can have a drain (not illustrated) to discharge the received spitted ink.

Referring to FIG. 8, when the maintenance motor 301 rotates the gear 401, the second arm 220 is rotated from a rest position to a cap position. The slot 222 pushes the guide shaft 63 in a direction parallel to the paper delivery path when the second arm 220 rotates about the rotatable shaft 224 inserted into the hole 110. The platen 60 then moves to the discharge unit 30 along the guide groove 120 since the protuberance 61 of the platen 60 slides along the guide groove 120. The first arm 210 pivots on the hinge pole 62 while the hinge pole 62 moves together with the platen 60 in the direction, and the cam-follower 213 moves along the rotation interval 131 of the first cam trace 130. The wiper 80 contacts the nozzle unit 11. When the cam-follower 213 is guided by the sustain interval 132, the wiper 80 moves in a straight line to wipe the nozzle unit 11 while continuously contacting the nozzle unit 11.

When a blade 81 is used for the wiper 80 (as illustrated in FIG. 16), ink may be splashed when the blade 81 flicks as the blade 81 passes off an end 11*a* of the nozzle unit 11, which could contaminate the image forming apparatus. Therefore, according to the image forming apparatus of the present embodiment, the cam-follower 213 is guided by the separating interval 133 and the wiper 80 is spaced from the nozzle unit 11 before the wiper 80 reaches the end 11*a* of the nozzle unit 11.

When the wiper 80 leaves the nozzle unit 11 completely, the platen 60 is positioned at the maintenance position and the cap member 90 caps the nozzle unit 11 according to a movement (rotation) of the second arm 220 with respect to the rotatable shaft 224 as illustrated in FIG. 9. That is, the platen 60 moves from the printing position to the maintenance (non-printing) position when the wiper moves according to a movement of the cam follower 213 along the intervals 131, 132, and 133, and the cap member 90 moves to the cap position as illustrated in FIG. 8. Since the platen 60 has the concave groove 68, the platen 60 does not interfere with the discharge unit 30.

The process of moving the platen 60 from the maintenance position to the printing position is the reverse of that of moving the platen 60 from the printing position to the maintenance position, described above. In the case where the first cam trace 130 does not have the returning interval 134, the cam follower 213 moves along an interval 136, the sustained interval 132, and the rotation interval 131 so that the wiper 80 contacts the nozzle unit 11 again and returns to a position illustrated in FIG. 3. At this point, ink can be returned from the wiper 80 back to the nozzle unit 11, but this problem can be overcome at least to some extent by controlling a contact angle of the wiper 80. On the other hand, in the case where the first cam trace 130 has the returning interval 134, since the wiper 80 returns to the position illustrated in FIG. 3 without contacting the nozzle unit 11, it is possible to more effectively prevent the nozzle unit 11 from being contaminated by the ink on the wiper 80. When lengths and angles of the intervals 131, 132, 133, and 134 are changed, the wiper 80 has corresponding periods of time to wipe the nozzle unit 11 and to move between a rest position and a wiping position.

Referring to FIGS. 4 and 7, the returning interval 134 has the elastic arm 135, so that the cam-follower 213 pushes the elastic arm 135 to a position marked by a dotted line in FIG. 7, and returns to the rotation interval 131. When the cam-follower 213 returns to the rotation interval 131, the elastic arm 135 returns to the position marked by a solid line in FIG. 7. Since the elastic arm 135 serves as a latch when the platen 60 moves to the maintenance position, the cam-follower 213 does not enter the returning interval 134 but is guided to the sustain interval 132 along the rotation interval 131.

Figure 10:
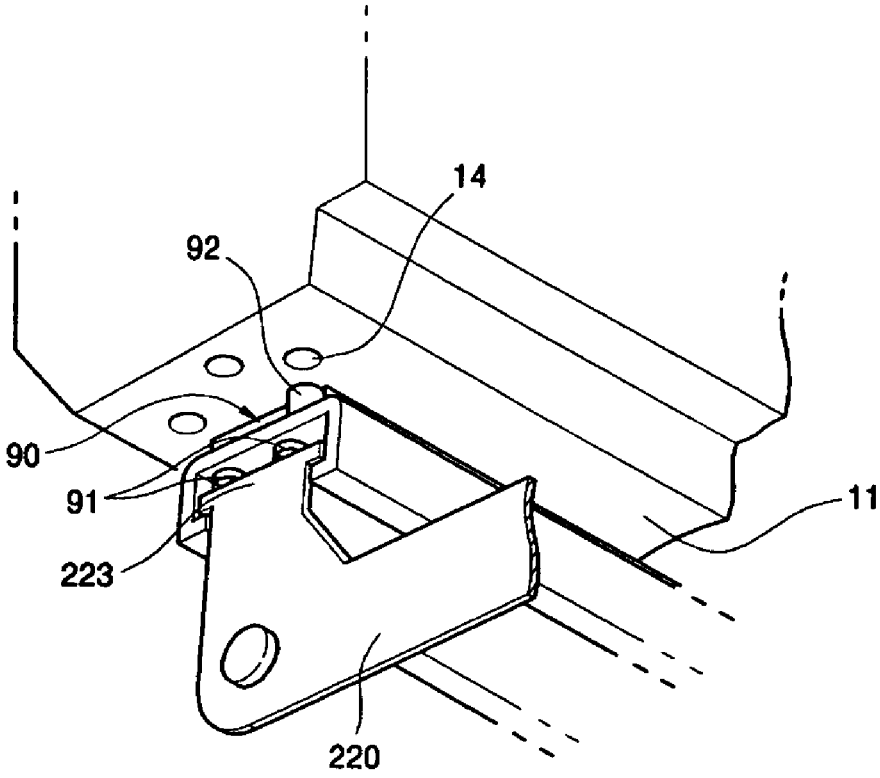
FIG. 10 is a view illustrating first and second reference parts of the maintenance device of FIG. 3 according to an embodiment of the present general inventive concept.

FIG. 10 is a view illustrating a first reference part and a second reference part of the maintenance device of FIG. 3 according to an embodiment of the present general inventive concept. Referring to FIG. 10, to align the cap member 90 and the nozzle unit 11, the cap member 90 has the first reference part and the nozzle unit 11 has the second reference part. The first and second reference parts may have complementary shapes. To prevent interference with the paper P delivered below the nozzle unit 11 during a printing process, the second reference part of the nozzle unit 11 may have, for example, a concave shape. On the other hand, the first reference part may be, for example, a reference protuberance 92 protruding from the cap member 90. Also, the second reference part may be a recessed part 14 recessed from the lower surface of the nozzle unit 11 to receive the reference protuberance 92. The cap member 90 is supported to elastically move horizontally and vertically with respect to the other end 223 of the second arm 220, such that the first reference part may be coupled with second reference part. For that purpose, an elastic member 91 may be interposed between the cap member 90 and the second arm 220 as illustrated in FIG. 10.

With the cap member 90 capping the nozzle unit 11, a volume of an inner space defined by the cap member 90 and the nozzle unit 11 may be as small as possible. With the nozzle unit 11 capped, moisture of ink exposed to the inner space through the nozzle 13 evaporates from the ink into the inner space. When the inner space is saturated with this evaporated moisture, no further moisture evaporates from the ink. As the volume of the inner space is small, the inner space easily becomes saturated with this evaporated moisture. In other words, an amount of moisture required to saturate the inner space becomes very small. When the volume of the inner space is large, more moisture of the ink in the nozzle 13 may evaporate, which increases the viscosity of the ink and may block the nozzle 13 or change the firing direction of the ink. Also, to saturate the inner space, spitting may be performed when the nozzle unit 11 is capped.

At this point, when the volume of the inner space is small, the amount of spitting can be reduced, and thus ink consumption can be reduced. To reduce the volume of the inner space, the size of the cap member 90 should be made as small as possible and the cap member 90 should be positioned exactly to accurately cap the nozzle unit 11. According to the present embodiment, the positions of the cap member 90 and the nozzle unit 11 may be accurately aligned by providing the first and second reference parts, so that the size of the cap member 90 can be minimized. Therefore, the volume of the inner space defined by the cap member 90 and the nozzle unit 11 can be minimized.

According to the above embodiment, the wiper 80 is connected to the platen 60 to wipe the nozzle unit 11 in cooperation with the movement of the platen 60. Since the platen 60 and the wiper 80 move in the subsidiary scanning direction (S), the maintenance device may be simplified by connecting the platen 60 and the wiper 80. Also, according to the present embodiment, the cap member 90, the wiper 80, and the platen 60 may be configured to all be driven by the maintenance motor 301, so that a structure of the maintenance device can be further simplified.

Figure 12:
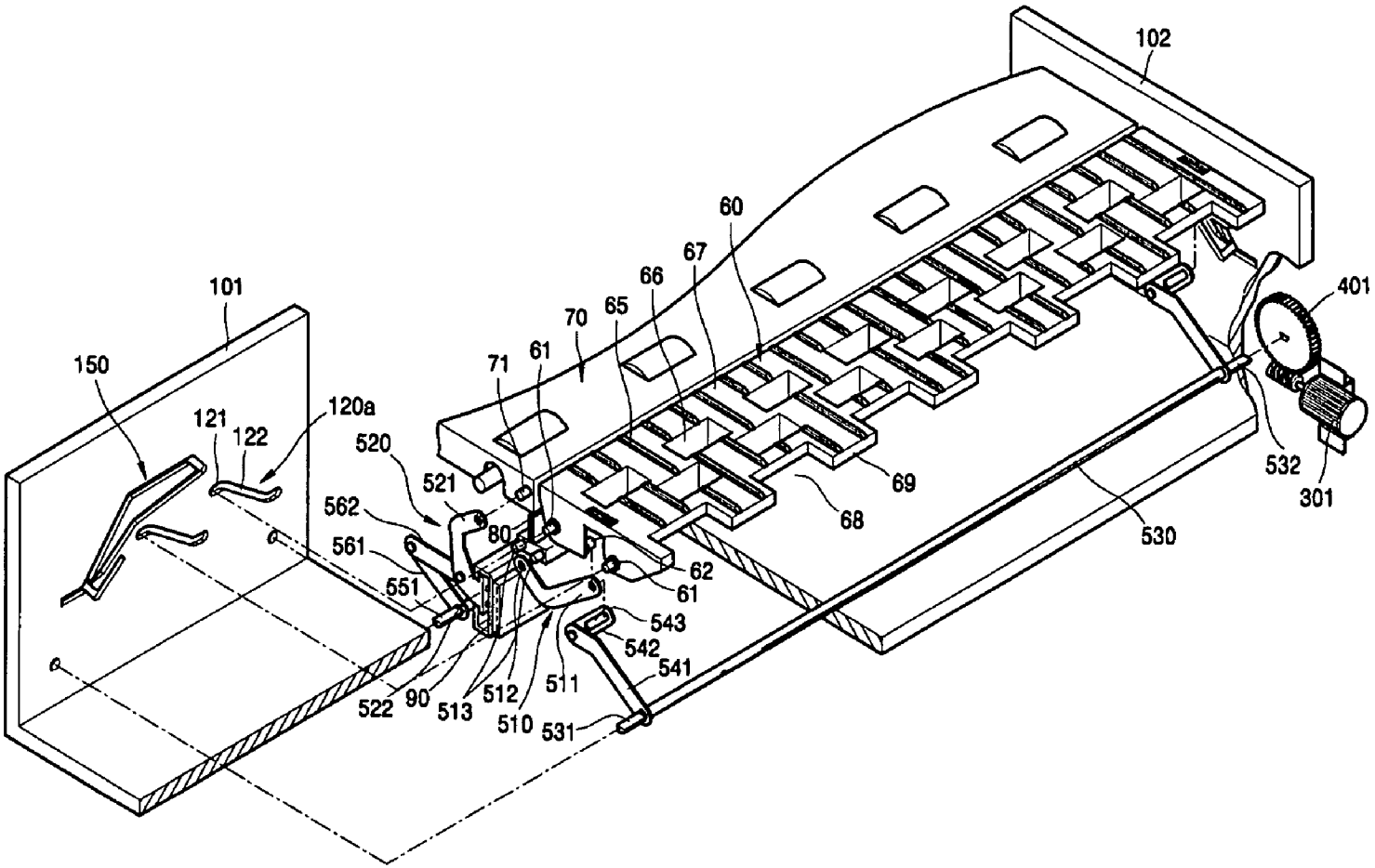
FIG. 12 is an exploded perspective view illustrating the maintenance device of FIG. 11 according to an embodiment of the present general inventive concept.

FIGS. 11 and 12 are a structural view and an exploded perspective view, respectively, illustrating another embodiment of the maintenance device of the image forming apparatus of FIG. 1. A discharge unit 30 may be positioned near a nozzle unit 11 so as to reliably deliver paper P. When a length in a subsidiary scanning direction (S) of the nozzle unit 11 is long, a movement distance of the platen 60 (a distance between a printing position and a maintenance position) is lengthened, and thus there is a high probability that the platen 60 may interfere with the discharge unit 30 when the platen 60 moves substantially parallel to a paper delivery path 100. Therefore, according to the maintenance device of the present embodiment, a distance between the platen 60 and the nozzle unit 11 at the printing position is greater than a distance between the platen 60 and the nozzle unit 11 at the maintenance position. In other words, the platen 60 is positioned below the discharge unit 30 at the maintenance position. A cap member 90 should cap the nozzle unit 11 after the platen 60 has completely moved to the maintenance position and wiping is completed.

When the movement distance of the platen 60 is long, it may be difficult to perform this series of sequential processes using one drive source. Therefore, according to the maintenance device of the present embodiment, the platen 60 and the wiper 80 are both driven by a maintenance motor 301 and the cap member 90 is driven by another drive source. In the present embodiment, the cap member 90 is driven by a drive motor 302. The drive motor 302 may also drive a delivery unit 20 and the discharge unit 30. In this case, a pick-up roller 40 to pick up paper P from a paper-feed cassette 50 can be driven by the other drive source. In the case where the pick-up roller 40 is driven by the driver motor 302, a clutch (not illustrated) to selectively deliver a driving force of the drive motor 302 to the pick-up roller 40 may be provided. Since the clutch is well known to those skilled in the art, a detailed description thereof will be omitted.

The platen 60 of FIG. 11 may be the same as the platen 60 illustrated in FIG. 5. Referring to FIGS. 5, 11, and 12, a plurality of ribs 65 are formed on the platen 60 to support a backside of paper P. The platen 60 has a plurality of receiving parts 66 that correspond to an arrangement of a plurality of nozzle plates 12 illustrated in FIG. 2 to receive ink spitted by the nozzle unit 11. The discharge unit 30 is the same as that illustrated in FIG. 6. The platen 60 has a plurality of concave grooves 68 that correspond to a plurality of roller parts 32 of the discharge unit 30. When the platen 60 is positioned at the printing position, the roller parts 32 are positioned in the concave grooves 68. By the above construction, the paper P may be reliably delivered using the delivery unit 20 by positioning the discharge unit 30 near to the nozzle unit 11.

Referring to FIG. 12, a second cam trace 120*a* is formed in sidewalls 101 and 102. A protuberance 61 may be formed on both side portions of the platen 60. The protuberance 61 is insertable into the second cam trace 120*a*. The platen 60 is moveable between the printing position and the maintenance position along the second cam trace 120*a*. The second cam trace 120*a* has a parallel interval 121 (a first interval) that is parallel with the paper delivery path 100, and an inclined interval 122 (a second interval) inclined downward.

Referring to FIG. 12, a long slot 543 is formed in a second connecting arm 542. A guide shaft 63 (see FIGS. 4 and 5) is formed in the platen 60 to be insertable into the slot 543. The guide shaft 63 may be formed between the two protuberances 61 which are insertable into the corresponding second cam traces 120*a*. A shaft 530 is rotatably supported by the sidewalls 101 and 102.

Chamfered portions 531 and 532 are formed at both ends of the shaft 530. A pair of first connecting arms 541 is coupled to the chamfered portions 531 and 532 of the shaft 530, and are rotatably connected to a pair of second connecting arms 542. A gear 401 is connected to the chamfered portion 532. A maintenance motor 301 rotates the gear 401 to move the platen 60 to the printing position and the maintenance position.

A third arm 520 is rotatably attached to a guide member 70 to guide a sheet of paper to the lower portion of the nozzle unit 11. One end 521 of the third arm 520 is coupled to a rotation shaft 71 formed in the guide member 70 (see FIG. 13). The cap member 90 is installed at the other end 522 of the third arm 520. A shaft 550 (see FIG. 13) is rotatably supported by the sidewalls 101 and 102. A chamfered portion 551 is formed at both ends of the shaft 550. A pair of third connecting arms 561 is coupled to the chamfered portion 551 of the shaft 550 and rotatably coupled to a pair of fourth connecting arms 562. The pair of fourth connecting arms 562 is rotatably connected to the third arm 520.

Figure 13:
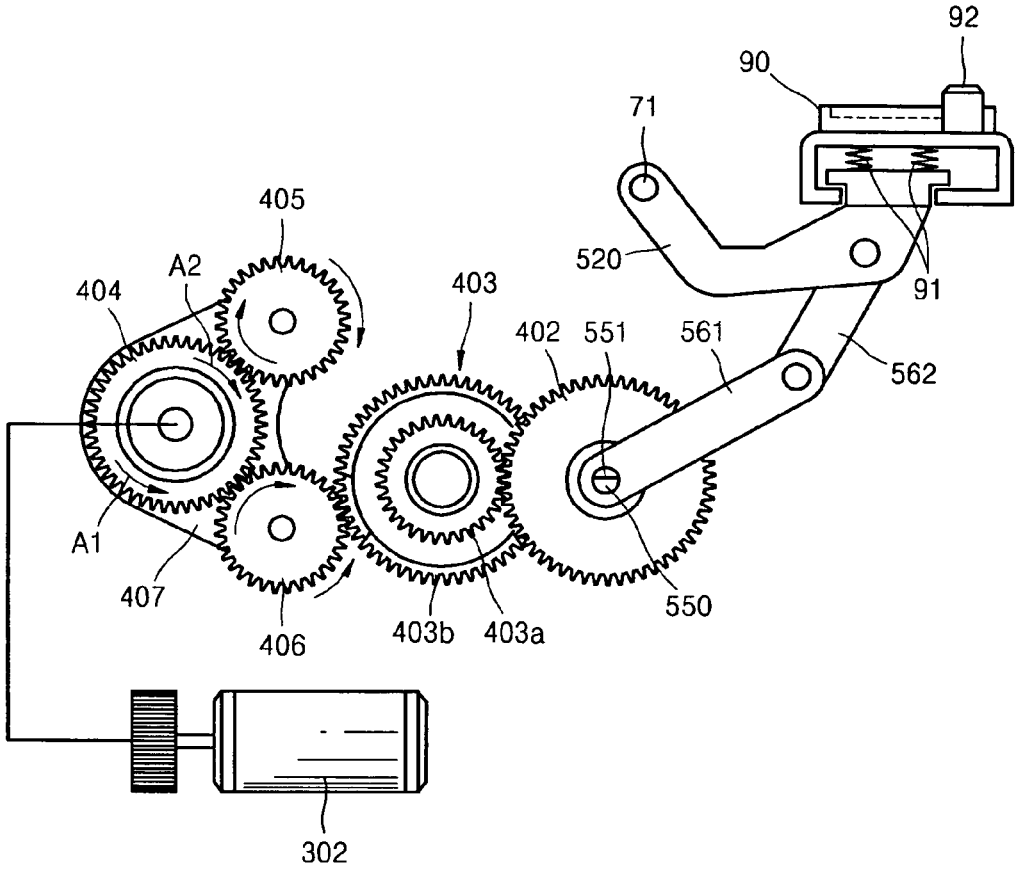
FIG. 13 is a view illustrating a drive motor to drive a cap member of FIG. 11 according to an embodiment of the present general inventive concept.

FIG. 13 is a view illustrating a drive motor 302 to drive the cap member 90 of FIG. 11 to a capped position and an uncapped position. The drive motor 302 also drives the delivery unit 20 and the discharge unit 30. Though not illustrated in FIG. 13, the drive motor 302 is connected to the delivery unit 20 and the discharge unit 30 by a power-connecting element, such as a gear. Since the paper P is not picked up from a paper-feed cassette 50 while a capping operation is performed, the paper P is not delivered even though the drive motor 302 operates and the delivery unit 20 and the discharge unit 30 operate. A gear 402 is coupled to the chamfered portion 551 of the shaft 550. A driven gear 403 has first and second gear parts 403*a* and 403*b*. The first gear part 403*a* is engaged with the gear 402. A pair of swing gears 405 and 406 is engaged with a gear 404 rotated by the drive motor 302. The pair of swing gears 405 and 406 is installed on a swing arm 407. The swing gears 405 and 406 are selectively engaged with the second gear part 403*b* of the driven gear 403 along a rotation direction A1 and A2, respectively, of the gear 404.

Figure 14:
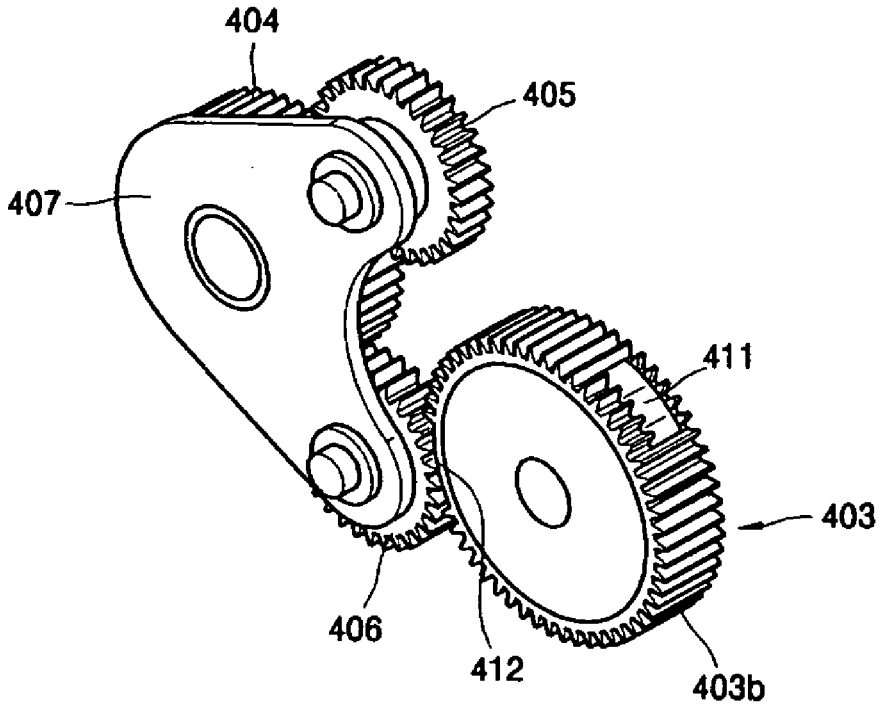
FIG. 14 is a detailed perspective view illustrating swing gears and a driven gear of the drive motor of FIG. 13 according to an embodiment of the present general inventive concept.

FIG. 14 is a detailed perspective view illustrating the swing gears 405 and 406 and the driven gear 403 of the drive motor 302 of FIG. 13 according to an embodiment of the present general inventive concept. Referring to FIG. 14, a pair of idling parts 411 and 412 where gear teeth have been omitted is formed in the second gear part 403*b* of the driven gear 403. The idling parts 411 and 412 correspond respectively to uncapped and capped positions of the cap member 90. Also, the idling parts 411 and 412 respectively correspond to the swing gears 405 and 406.

When the gear 404 rotates in the direction A1 in FIG. 13 with respect to a rotation axis of the gear 404, the swing arm 407 is rotated in the direction A1 with respect to the rotation axis, so that the swing gear 406 is engaged with the second gear part 403*b* of the driven gear 403. The cap member 90 is moved from the capped position to the uncapped position. When the cap member 90 reaches the uncapped position, the swing gear 406 is positioned at the idling part 412, so that the cap member 90 is not rotated even when the swing gear 406 rotates.

When the gear 404 rotates in the direction A2 in FIG. 13 with respect to the rotation axis, the swing arm 407 is also rotated in the direction A2 with respect to the rotation axis, so that the swing gear 405 is engaged with the second gear part 403*b* of the driven gear 403. The cap member 90 moves from the uncapped position to the capped position. When the cap member 90 reaches the capped position, the swing gear 405 is positioned at the idling part 411, so that the cap member 90 is not rotated even when the swing gear 405 rotates.

When the drive motor 302 rotates the gear 404 in the direction A1, the delivery unit 20 and the discharge unit 30 may operate in a direction that delivers the paper P in the subsidiary scanning direction (S). With such a construction, the delivery unit 20, the discharge unit 30, and the cap member 90 may all be driven using the drive motor 302.

Figure 15:
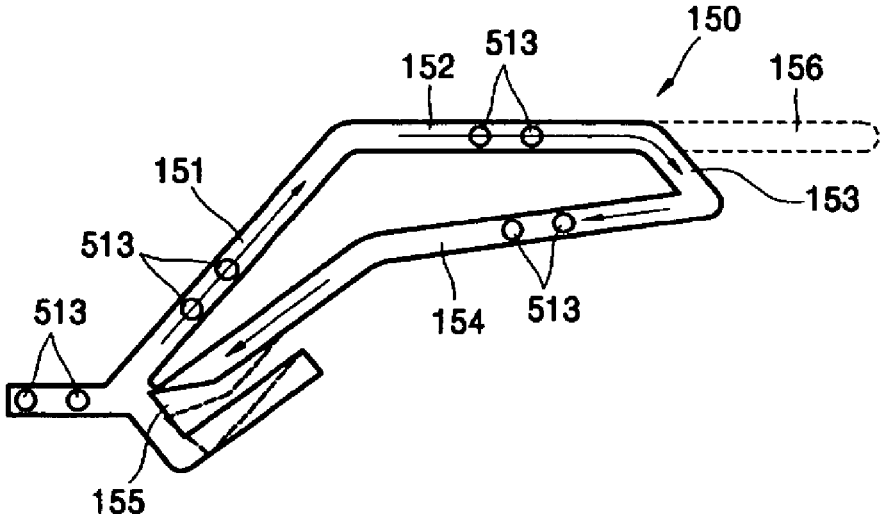
FIG. 15 is a detailed view illustrating a third cam trace of the maintenance device of FIG. 11 according to an embodiment of the present general inventive concept.

FIG. 15 is a detailed view illustrating a third cam trace 150 of the maintenance device of FIG. 11 according to an embodiment of the present general inventive concept. Referring to FIGS. 11, 12, and 15, the third cam trace 150 is formed in the sidewalls 101 and 102. One end 511 of a fourth arm 510 is rotatably coupled to a hinge pole 62 formed in the platen 60. A wiper 80 is pivotably coupled to the other end 512 of the fourth arm 510.

The wiper 80 may be a blade 81 or a roller 82, as illustrated in FIGS. 16 and 17. A cam-follower 513 formed on a side portion of the wiper 80 may be coupled with the third cam trace 150. Referring to FIG. 15, the third cam trace 150 has a rotation interval 151 to guide the wiper 80 such that the wiper 80 contacts the nozzle unit 11 as the platen 60 moves from the printing position to the maintenance position, and a sustain interval 152 to maintain a continuous contact between the wiper 80 and the nozzle unit 11. Guided by the rotation interval 151, the fourth arm 510 is rotated in a direction such that the wiper 80 contacts the nozzle unit 11. Also, the third cam trace 150 may further have a separating interval 153 to separate the wiper 80 from the nozzle unit 11. The third cam trace 150 may further have a returning interval 154 to guide the fourth arm 510 such that the wiper 80 may not contact the nozzle unit 11 when the platen 60 returns from the maintenance position to the printing position. In the case where the separating interval 153 is not included in the third cam trace 150, the sustain interval 152 extends to an interval 156 marked by a dotted line in FIG. 15. An elastic arm 155 serves as a latch that allows the cam-follower 153 to move from the returning interval 154 to the rotation interval 151, but prevents the cam-follower 153 from moving from the rotation interval 151 to the returning interval 154.

A maintenance operation by the maintenance device illustrated in FIGS. 11 through 15 will now be described. Referring to FIG. 11, the platen 60 is positioned at the printing position to support the backside of the paper P (see. FIG. 1). The protuberance 61 of the platen 60 is supported by the parallel interval 121 of the second cam trace 120*a* that is parallel with the paper delivery path 100 (see FIG. 12). Therefore, even if the position accuracy of the platen 60 at the printing position deteriorates slightly, the interval between the nozzle unit 11 and the upper surface of the paper P can be accurately maintained as far as the protuberance 61 is supported by the parallel interval 121. The wiper 80 and the cap member 90 are positioned below the platen 60. In this state, the delivery unit 20 is driven by a drive motor 302, so that the paper P is delivered through the paper delivery path 100 and ink is fired onto the paper P to print an image. At this point, since the swing gear 406 is positioned at the idling part 412 of the driven gear 403, the driven gear 403 is not rotated. Therefore, the cap member 90 does not move from the uncapped position. Also, when no paper P exists in the paper delivery path 100, before an image is printed or after printing several sheets of paper, a spitting operation is performed. Spat ink falls into a plurality of receiving parts 66 formed in the platen to correspond to the arrangement of the nozzle plates 12. Therefore, the backside of the paper P is not contaminated by the ink in the receiving parts 66 even when the paper P is delivered after the spitting.

Figure 18:
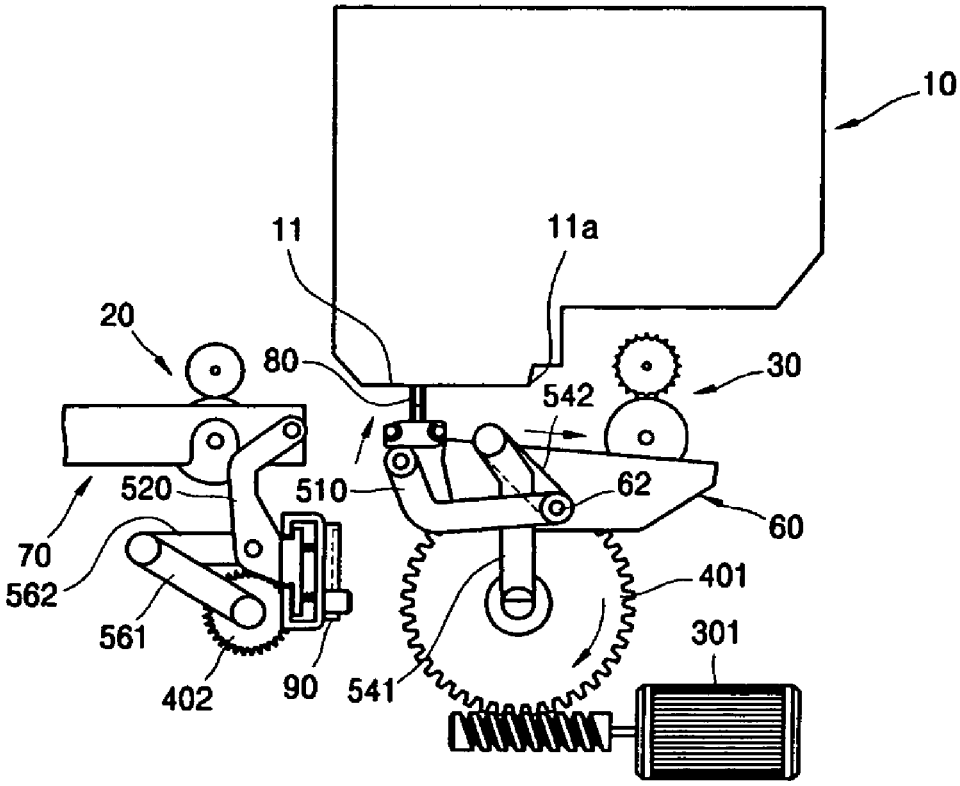
FIGS. 18 and 19 are views illustrating a movement operation and a wiping operation, respectively of a platen of the maintenance device of FIG. 11 according to an embodiment of the present general inventive concept.
Figure 19:
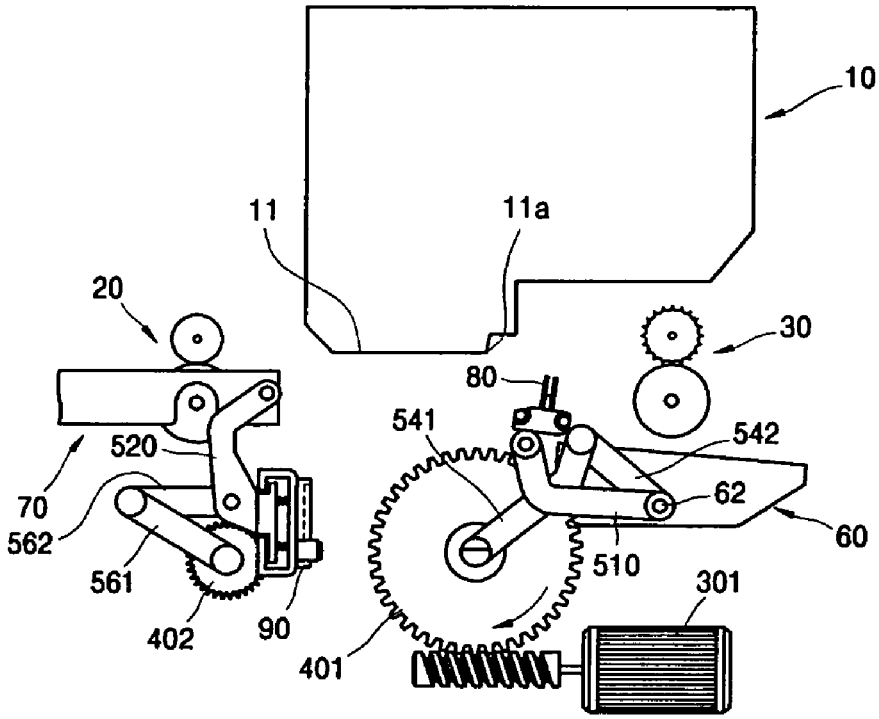
Figure 20:
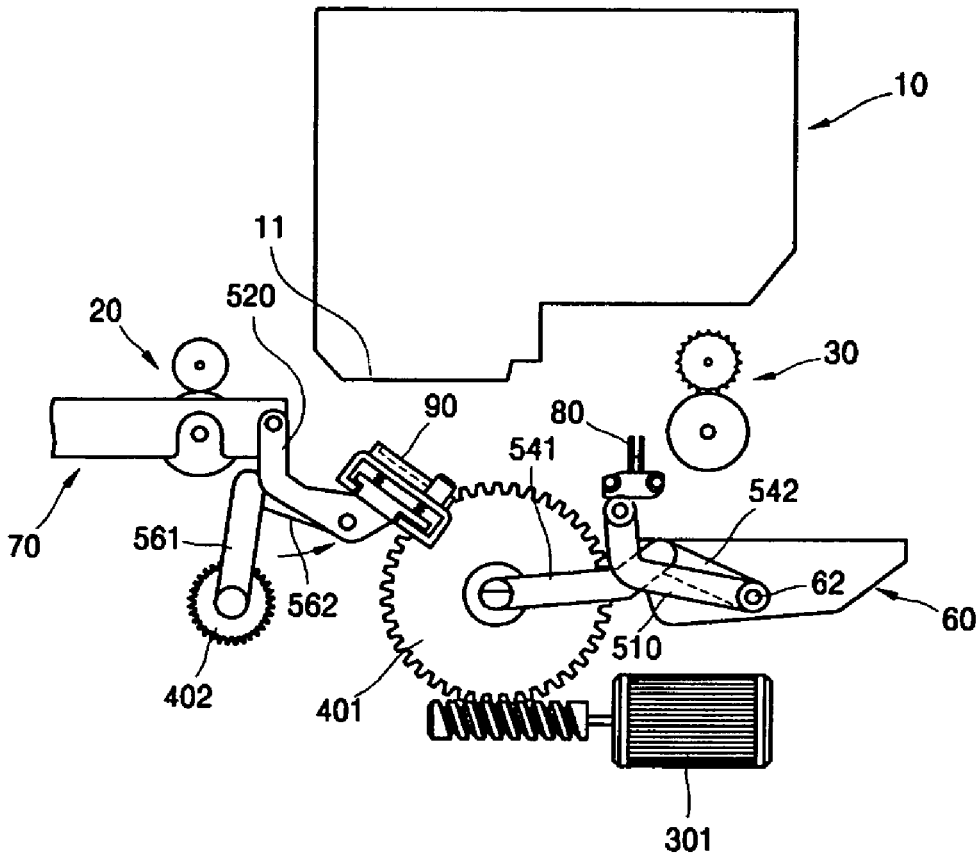
FIGS. 20 and 21 are views illustrating a capping operation of the maintenance device of FIG. 11 according to an embodiment of the present general inventive concept.
Figure 21:
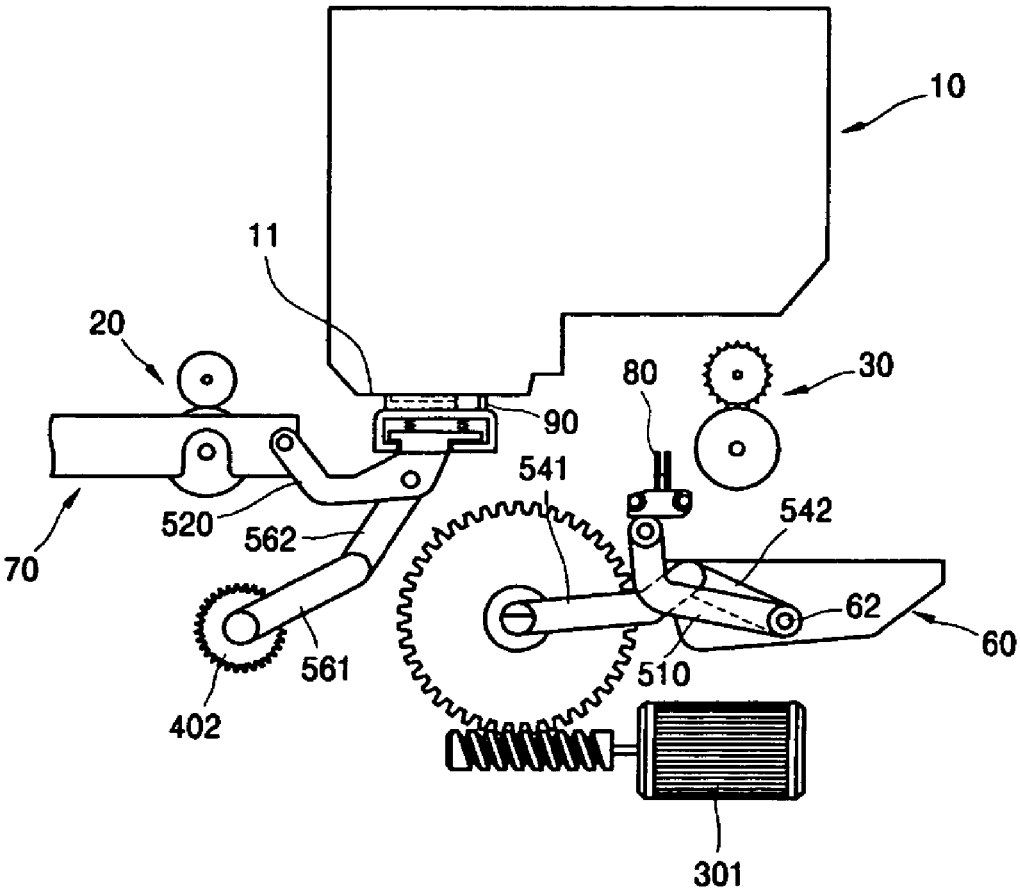

FIGS. 18 and 19 are views illustrating a movement operation and a wiping operation, respectively of the platen 60 of the maintenance device of FIG. 11 according to an embodiment of the present general inventive concept. FIGS. 20 and 21 are views illustrating a capping operation of the maintenance device of FIG. 11 according to an embodiment of the present general inventive concept.

When a maintenance motor 301 rotates the gear 401, the shaft 530 and the connecting arms 541 and 542 are rotated. A slot 543 of the connecting arm 542 pushes the hinge pole 62. When the protuberance 61 of the platen 60 leaves the parallel interval 121, the platen 60 is guided by the inclined interval 122. Referring to FIG. 18, the platen 60 is moved below the discharge unit 30. The fourth arm 510 pivots on the hinge pole 62 and the cam-follower 513 is guided by the rotation interval 151 of the third cam trace 150, so that the wiper 80 contacts the nozzle unit 11. After the wiper 80 contacts the nozzle unit 11, the cam-follower 513 is guided by the sustain interval 152. The wiper 80 moves in a straight line to wipe the nozzle unit 11 while continuously contacting the nozzle unit 11.

If a blade 81 is used for the wiper 80, as illustrated in FIG. 16, ink may be splashed when the blade 81 flicks as the blade 81 it passes off the end 11*a* of the nozzle unit 11, which could contaminate the image forming apparatus. Therefore, according to the image forming apparatus of the present embodiment, the cam-follower 513 is guided by the separating interval 153, and the wiper 80 is spaced from the nozzle unit 11 before the wiper 80 reaches the end 11*a* of the nozzle unit 11. When the platen 60 is positioned at the maintenance position, as illustrated in FIG. 19, the wiper 80 completely leaves the nozzle unit 11.

Next, the drive motor 302 actuates the capping of the nozzle unit 11. At this point, since the paper P has not been picked up from the paper-feed cassette 50, no paper P is delivered, even when the delivery unit 20 is driven. Referring to FIG. 13, when the drive motor 302 rotates the gear 404 in the direction A2, the swing gear 405 is engaged with the second gear part 403*b* of the driven gear 403. The driven gear 403 rotates in the direction A2 and the connecting arms 541 and 542 push the third arm 520. The third arm 520 pivots on a rotation shaft 71 formed in the guide member 70, and the cap member 90 starts to move toward the nozzle unit 11, as illustrated in FIG. 20. Referring to FIG. 21, when the cap member 90 caps the nozzle unit 11, the swing gear 405 is positioned at the idling part 411 of the driven gear 403, so that the cap member 90 does not move, even when the drive motor 302 rotates.

Figure 22:
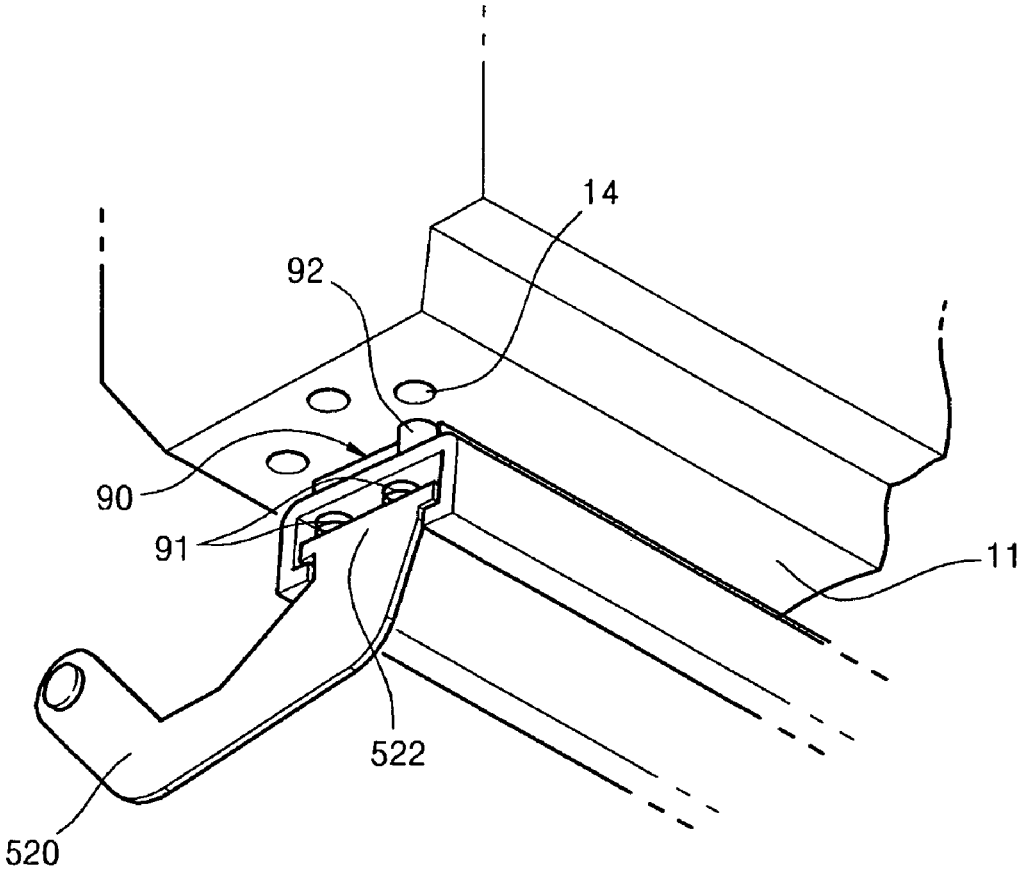
FIG. 22 is a view illustrating first and second reference parts of the maintenance device of FIG. 11 according to an embodiment of the present general inventive concept.

FIG. 22 is a view illustrating first and second reference parts of the maintenance device of FIG. 11 according to an embodiment of the present general inventive concept. To align the cap member 90 with the nozzle unit 11, the cap member 90 may have the first reference part and the nozzle unit 11 may have the second reference part, as illustrated in FIG. 22.

The first and second reference parts may have a complementary shape. The second reference part may have, for example, a concave shape. On the other hand, the first reference part may be, for example, a reference protuberance 92 protruding from the cap member 90. Also, the second reference part may be a recessed part 14 recessed from a lower surface of the nozzle unit 11 to receive the reference protuberance 92. The cap member 90 is supported to elastically move horizontally and vertically with respect to the other end 522 of the third arm 520, so that the first reference part may be coupled with second reference part. For that purpose, an elastic member 91 may be interposed between the cap member 90 and the third arm 520, as illustrated in FIG. 22.

Thus, the cap member 90 may be accurately aligned with the nozzle unit 11 by providing the first and second reference parts, so that a size of the cap member 90 can be minimized. Therefore, a volume of an inner space defined by the cap member 90 and the nozzle unit 11 can be minimized.

Referring to FIG. 13, when the drive motor 302 rotates the gear 404 in the direction A1 for the uncapping operation, the swing gear 406 is engaged with the second gear part 403*b* of the driven gear 403. The driven gear 403 is rotated in the direction A1 and the connecting arms 541 and 542 pull the third arm 520. The third arm 520 pivots on the rotation shaft 71 formed in the guide member 70 and the cap member 90 is spaced from the nozzle unit 11. Referring to FIG. 19, when the cap member 90 reaches the uncapped position, the swing gear 406 is positioned at the idling part 412 of the driven gear 403, so that the cap member 90 does not move, even when the drive motor 302 rotates.

Next, the platen 60 is moved to the maintenance position. The process of moving the platen 60 from the maintenance position to the printing position is the reverse of that of moving the platen 60 from the printing position to the maintenance position described above. The third cam trace 150 has the returning interval 154 so that the wiper 80 does not contact the nozzle unit 11 during the process in which the platen 60 returns to the printing position. The returning interval 154 has the elastic arm 155 as illustrated in FIGS. 12 and 15, and the cam-follower 513 pushes the elastic arm 155 and returns to the rotation interval 151. Since the elastic arm 155 serves as a latch when the platen 60 moves to the maintenance position, the cam-follower 513 does not enter the returning interval 154, but is guided by the rotation interval 151.

The wiping can be performed before or during printing. The capping is performed after printing is completed. Therefore, the capping can be accompanied by the wiping, but the wiping can be independently performed without the capping. Also, the wiping may be performed more frequently than the capping. According to the above embodiment, the capping operation and the wiping operation may be separated, so that the wiping operation can be performed swiftly, since it is performed frequently. Also, since the wiping operation can be performed by driving only a few elements, a reliability of the maintenance operation can improve.

In the above embodiment, the wiper 80 is configured to wipe the nozzle unit 11 while the platen 60 moves from the printing position to the maintenance position, but the wiper 80 can be also configured to wipe the nozzle unit 11 while the platen 60 moves from the maintenance position to the printing position, and may not contact the nozzle unit 11 while the platen 60 moves from the printing position to the maintenance position. Such configurations can be achieved by modifying the cam traces 130 and 150.

According to the above embodiment, the platen 60 and the wiper 80 may be simultaneously driven by one drive source, and the cap member 90 may be driven by another drive source; however, the platen 60 and the cap member 90 can instead be simultaneously driven by one drive source and the wiper 80 can be driven by another drive source. In this case, while the platen 60 moves from the printing position to the maintenance position, and before the cap member 90 reaches the capped position, the wiper 80 wipes the nozzle unit 11. When the platen 60 reaches the maintenance position after the wiping operation is completed, the cap member 90 reaches the capped position.

Also, although the platen 60 is moved toward the discharge unit 30 in the maintenance operation in the above embodiment, the platen 60 can also be moved toward the delivery unit 20 for the maintenance operation. For that purpose, the elements explained in the above embodiment can be mirrored with respect to the nozzle unit 11.

Figure 23:
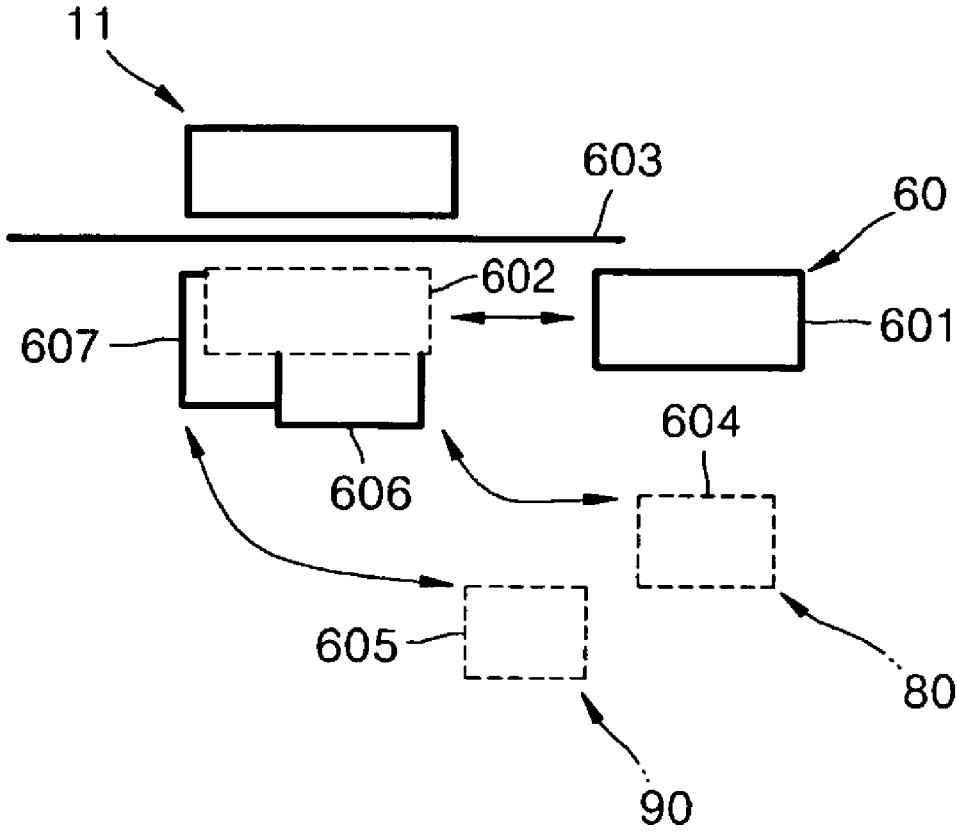
FIG. 23 is a view illustrating movements of the platen, the wiper, and a cap member of the maintenance device of FIG. 3, according to an embodiment of the present general inventive concept.
Figure 24:
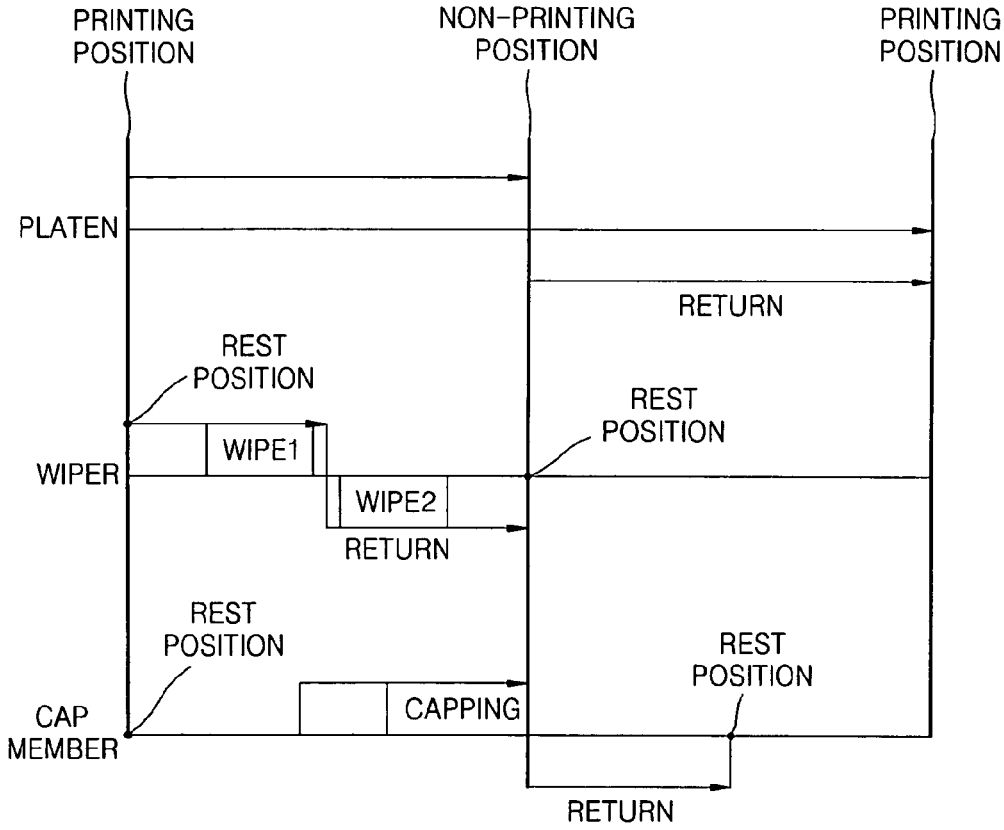
FIG. 24 is a view illustrating a relationship of positions of the platen, the wiper, and a cap member of FIG. 23 during the respective movements thereof, according to an embodiment of the present general inventive concept.

FIG. 23 is a view illustrating printing and non-printing positions of the platen 60, and maintenance and resting positions of the wiper 80 and the cap member 90, of the maintenance device of FIG. 3, according to an embodiment of the present general inventive concept. FIG. 24 is a view illustrating a relationship between the printing and non-printing positions of the platen 60 relative to the maintenance and resting positions of the wiper 80 and the cap member 90 of FIG. 23 during respective movements thereof, according to an embodiment of the present general inventive concept.

Referring to FIG. 23, the platen 60 is moveable between a non-printing position 601 (solid line) and a printing position 602 (dotted line) opposite to the nozzle unit 11 along a delivery path 603 formed by the platen 60 and the nozzle unit 11. The wiper 80 and the cap member 90 are moveable between a maintenance position corresponding to the printing position 602 and resting positions 604 and 605, respectively, (dotted lines) disposed opposite to the delivery path 603 with respect to the printing position 602. In particular, the wiper 80 is moveable between the resting position 604 and a wiping position 606, and the cap member 90 is moveable between the resting position 605 and a capping position 607. However, the present general inventive concept is not limited to this arrangement. For example, the wiper 80 may be moveable between the wiping position 606, the resting position 604, and a second resting position (see FIGS. 3, 8, and 9).

As illustrated in FIG. 23, when the platen 60 is disposed in the printing position 602, the wiper 80 and the cap member 90 are disposed in the resting positions 604 and 605, respectively. On the other hand, when the platen 60 is disposed in the non-printing position 601, one of the wiper 80 and the cap member 90 is disposed in the maintenance position (i.e., the wiping position 606 or the capping position 607, respectively), and the other of the wiper 80 and the cap member 90 is disposed in the corresponding resting position 604 or 605. For example, when the platen 60 is disposed in the non-printing position 601, the wiper 80 may be disposed in the wiping position 606, and the cap member 90 may be disposed in the resting position 605. Alternatively, when the platen 60 is disposed in the non-printing position 601, the cap member 90 may be disposed in the capping position 607 and the wiper 80 may be disposed in the resting position 604.

Referring to FIGS. 23 and 24, when the platen 60 is disposed in the printing position 602, the wiper 80 and the cap member 90 are disposed in the corresponding resting positions 604 and 605, respectively. In order to perform maintenance on the nozzle unit 11, the platen is moved from the printing position 602 to the non-printing position 601. When the platen 60 begins to move from the printing position 602 towards the non-printing position 601, the wiper 80 and the cap member 90 each begin to move from the resting positions 604 and 605, respectively, towards the wiping and capping positions 606 and 607, respectively. The wiper 80 and the cap member 90 are not required to begin moving from the resting positions 604 and 605 at exactly the same time that the platen 60 begins to move from the printing position 602, and thus the movements of the wiper 80 and/or the cap member 90 may be delayed such that the wiper 80 and/or the cap member 90 begin to move from the resting positions 604 and/or 605 at some time after the platen 60 begins to move from the printing position 602.

As the platen 60 moves towards the non-printing position 601, the wiper 80 and the cap member 90 move towards the wiping and capping positions 606 and 607, respectively. As illustrated in FIG. 24, the wiper 80 reaches the wiping position 606 at a first time period while the platen 60 is moving towards the non-printing position 601 and the cap member 90 is moving towards the capping position 607. After the wiper 606 wipes the nozzle unit 11 at the wiping position 606, the wiper 80 begins to move from the wiping position 606 back to the resting position 604. As illustrated in FIG. 24, the wiper 80 may wipe the nozzle unit 11 in a first direction (wiping 1) as the wiper 80 moves towards the wiping position 606, and then in a second direction (wiping 2) as the wiper 80 moves back towards the resting position 604. Alternatively, the wiper 80 may wipe the nozzle unit 11 in only one of the first direction (wiping 1) or the second (wiping 2).

As illustrated in FIG. 24, the cap member 90 reaches the capping position 607 at a second time period after the wiper 80 wipes the nozzle unit 11. While at the capping position 607, the cap member 90 caps the nozzle unit 11. At this point (i.e., when the nozzle unit 11 has been capped by the cap member 90), the platen 60 has reached the non-printing position 601, and the wiper 80 has reached the resting position 604. After the cap member 90 caps the nozzle unit 11 at the capping position 607, the cap member 90 begins to move from the capping position 607 back to the resting position 605.

As the cap member 90 moves from the capping position 607 towards the resting position 605, the platen 60 moves from the non-printing position 601 towards the printing position 602. The movements of the cap member 90 towards the resting position 605 and the platen 60 towards the printing position 602 are not required to being simultaneously, and thus the movement of the platen 60 may be delayed such that the cap member 90 begins to move towards the resting position 605 before the platen 60 begins to move towards the printing position 602. As discussed above, when the platen 60 reaches the printing position 602, the wiper 80 and the cap member 90 are disposed in the resting positions 604 and 605, respectively.

Although FIG. 24 illustrates that the wiper 80 begins and completes the wiping operation(s) before the cap member 90 reaches the capping position 607, the present general inventive concept is not so limited. Thus, the wiper 80 may perform a first wiping operation as the cap member 90 moves from the resting position 605 towards the capping position 607, and a second wiping operation as the cap member moves from the capping position 607 back towards the resting position 605 (see FIGS. 3, 8, and 9).

The present general inventive concept thus provides at least the following benefits and advantages.

A size of an image forming apparatus and an installation area thereof can be reduced by arranging a cap member and a wiping member lower than an upper surface of a platen and by moving the platen to a maintenance position and the printing position. Also, since a delivery unit and a discharge unit to deliver paper are not moved while the maintenance operation is performed, a power delivering device used to deliver paper can be simplified.

Furthermore, since a movement range of the platen is restricted to being below a paper delivery path, a space required to move the platen can be reduced, and thus the size of the image forming apparatus and the installation area thereof are also reduced.

In addition, since the wiping operation is performed in connection with the movement of the platen, a structure of the maintenance device can be simplified.

Also, since first and second reference parts may be provided to align the cap member with the nozzle unit, the volume of the inner space defined by the cap member and the nozzle unit can be reduced and thus the capping operation can be performed effectively.

Moreover, receiving parts for ink spitted by the nozzle unit may be provided on the platen, so that spitting can be performed swiftly.

Further, the cap member, the platen, and the wiper may be driven by one drive source to realize a maintenance device having a simple structure.

Still further, a drive source for the cap member and a drive source for the platen and the wiper can be separated, so that the wiping operation can be performed swiftly.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet image forming apparatus, comprising:

an inkjet head including a nozzle unit having a length in a main scanning direction equal to or greater than a width of a printing medium;

a platen facing the nozzle unit to support a backside of the printing medium, to form a delivery path with the nozzle unit, and to be moveable between a printing position and a maintenance position;

a wiper to wipe the nozzle unit; and a cap member to cap the nozzle unit, wherein the printing position constitutes the delivery path, the maintenance position is spaced apart from the printing position such that when the wiper and the cap member access the nozzle unit, the platen is located at an opposite side of the nozzle unit with respect to the delivery path, and a movement path of the platen between the printing position and the maintenance position comprises a parallel interval that is substantially parallel to the delivery path in which a gap between the platen and the nozzle unit remains constant and a sloped interval in which the gap between the platen and the nozzle unit changes.

2. The apparatus of claim 1, wherein the platen is located between the nozzle unit and at least one of the cap member and the wiper when the platen is positioned in the printing position.

3. The apparatus of claim 1, further comprising:

a delivery unit located at an entry side of the nozzle unit to deliver the printing medium to below the nozzle unit; and a discharge unit located at an exit side of the nozzle unit to discharge printed printing medium, wherein the platen is moveable toward the discharge unit to be positioned in the maintenance position.

4. The apparatus of claim 3, wherein the platen has a concave groove to prevent an interference of the platen with the discharge unit when the platen is positioned in the maintenance position.

5. The apparatus of claim 1, further comprising:

a delivery unit located at an entry side of the nozzle unit to deliver the printing medium to below the nozzle unit, wherein the platen is moveable toward the delivery unit to be positioned in the maintenance position.

6. The apparatus of claim 1, further comprising:

a discharge unit located at an exit side of the nozzle unit to discharge printed printing medium, wherein the platen is positioned below the discharge unit when the platen, is in the maintenance position.

7. The apparatus of claim 1, wherein the wiper is connected to and is moveable with the platen to wipe the nozzle unit while the platen moves between the printing position and the maintenance position.

8. The apparatus of claim 7, wherein the wiper wipes the nozzle unit during at least one of a time period in which the platen moves from the printing position to the maintenance position and a time period in which the platen moves from the maintenance position to the printing position, and the wiper does not contact the nozzle unit during any other time period.

9. The apparatus of claim 7, wherein the wiper wipes the nozzle unit during both of a time period in which the platen moves from the printing position to the maintenance position and a time period in which the platen moves from the maintenance position to the printing position.

10. The apparatus of claim 1, further comprising:

a first reference part in the cap member; and a second reference part in the nozzle unit to be coupled with the first reference part when the nozzle unit is capped.

11. The apparatus of claim 1, wherein the platen has receiving parts recessed from an upper surface of the platen facing the nozzle unit to receive ink spitted by the nozzle unit.

12. The apparatus of claim 11, wherein the nozzle unit has nozzle plates arranged in a zigzag pattern in a width direction of the printing medium, and the receiving parts of the platen are arranged in a zigzag pattern to correspond to the zigzag pattern of the nozzle plates.

13. The apparatus of claim 1, further comprising:

a driving source to drive the platen, the wiper, and the cap member.

14. The apparatus of claim 1, further comprising:

a first driving source to drive the wiper; and a second driving source to drive the cap member, wherein the first and second driving sources are independent of each other.

15. The apparatus of claim 14, wherein the first driving source drives the platen and the wiper.

16. The apparatus of claim 14, wherein the second driving source drives the platen and the cap member.

17. The apparatus of claim 1, further comprising:

a first arm having a first end rotatably coupled to the platen and a second end at which the wiper is installed; and a cam trace having a rotation interval in which the first arm is rotated such that the wiper is moved to contact the nozzle unit as the platen moves, and a sustain interval in which the wiper is kept in contact with the nozzle unit.

18. The apparatus of claim 17, wherein the cam trace further comprises a separating interval in which the first arm is rotated such that wiper is separated from the nozzle unit.

19. The apparatus of claim 18, wherein the cam trace further comprises a returning interval in which the first arm is rotated such that the wiper does not contact the nozzle unit.

20. The apparatus of claim 17, further comprising:

a second arm having a first end coupled to the platen and a second end on which a cap member is installed; and a maintenance motor to rotate the second arm to move the platen between the printing position and the maintenance position and to move the cap member from a lower portion of the platen to a capped position to cap the nozzle unit.

21. The apparatus of claim 20, further comprising:

a first reference part in the cap member; and a second reference part in the nozzle unit to be coupled with the first reference part at the capped position.

22. The apparatus of claim 20, wherein the cap member installed on the second end of the second arm is elastically moveable.

23. The apparatus of claim 1, further comprising:

a delivery unit to deliver the printing medium to the nozzle unit;

a discharge unit to discharge the printing medium from the nozzle unit;

a maintenance motor to move the platen between the printing position and the maintenance position; and a driver motor to drive the delivery unit and the discharge unit, and to drive the cap member to be moved between a capped position and an uncapped position.

24. The apparatus of claim 23, further comprising:

a pair of swing gears to be rotated by the drive motor;

an arm coupled with the cap member and rotatable between the capped position and the uncapped position; and a driven gear selectively engagable with one of the swing gears according to a rotation direction of the drive motor to rotate the arm to the capped position or the. uncapped position, the driven gear having a pair of idling parts on which gear teeth are omitted at positions that correspond to the capped position and the uncapped position.

25. The apparatus of claim 24, wherein the cap member coupled with the arm is elastically moveable.

26. The apparatus of claim 23, further comprising:

a first reference part in the cap member; and a second reference part in the nozzle unit to be coupled with the first reference part when the cap member is at the capped position.

27. The apparatus of claim 23, further comprising:

a cam trace to guide the platen that is moved by the maintenance motor, the cam trace having a first interval that corresponds to the parallel interval and a second interval that corresponds to the sloped interval.

28. The apparatus of claim 27, wherein the wiper is connected to and is moveable with the platen to wipe the nozzle unit while the platen moves between the printing position and the maintenance position.

29. The apparatus of claim 28, further comprising:

a second arm having a first end rotatably coupled to the platen and a second end on which the wiper is pivotably installed; and a second cam trace having a rotation interval to guide the wiper such that the wiper is moved to contact the nozzle unit as the platen moves, and a sustain interval in which the wiper is kept in contact with the nozzle unit.

30. The apparatus of claim 29, wherein the second cam trace further has a separating interval extending from the sustain interval to separate the wiper from the nozzle unit.

31. The apparatus of claim 30, wherein the second cam trace further has a returning interval to guide the second arm such that the wiper does not contact the nozzle unit.

32. An inkjet image forming apparatus, comprising:

an inkjet head including a nozzle unit having a length in a main scanning direction equal to or greater than a width of a printing medium;

a platen facing the nozzle unit to support the backside of the printing medium to form a delivery path, the platen being moveable between a printing position and a maintenance position;

a wiper to wipe the nozzle unit;

a cap member to cap the nozzle unit; and a delivery unit located at an entry side of the nozzle unit to deliver the printing medium to the delivery path, wherein the printing position constituting the delivery path and the maintenance position is spaced apart from the printing position such that when the wiper and the cap member each accesses the nozzle unit, the delivery unit remains at a fixed position with respect to the nozzle unit, and a movement path of the platen between the printing position and the maintenance position comprises a parallel interval that is substantially parallel to the delivery path in which a gap between the platen and the nozzle unit remains constant and a sloped interval in which the gap between the platen and the nozzle unit changes.

33. The apparatus of claim 32, further comprising:

a discharge unit fixedly-located at an exit side of the nozzle unit to discharge printed printing medium and having a fixed position.

34. The apparatus of claim 33, wherein the platen has a concave groove to prevent an interference of the platen with the discharge unit when the platen is positioned in the maintenance position.

35. The apparatus of claim 33, wherein the platen is positioned below the discharge unit when the platen is positioned in the maintenance position.

36. The apparatus of claim 32, wherein the platen is located at an opposite side of the nozzle unit with respect to the delivery path when the platen is positioned in the maintenance position.

37. The apparatus of claim 32, wherein the platen is located between the nozzle unit and at least one of the cap member and the wiper when the platen is positioned in the printing position.

38. The apparatus of claim 32, wherein the wiper is connected to and moveable with the platen to wipe the nozzle unit while the platen moves between the printing position and the maintenance position.

39. The apparatus of claim 38, wherein the wiper wipes the nozzle unit during at least one of a time period in which the platen moves from the printing position to the maintenance position and a time period in which the platen moves from the maintenance position to the printing position, and the wiper does not contact the nozzle unit during any other time period.

40. The apparatus of claim 32, further comprising:

a first reference part in the cap member; and a second reference part in the nozzle unit to be coupled with the first reference part when the nozzle unit is capped.

41. The apparatus of claim 32, wherein the platen has receiving parts:

recessed from an upper surface of the platen facing the nozzle unit to receive ink spitted by the nozzle unit.

42. The apparatus of claim 41, wherein the nozzle unit has nozzle plates arranged in a zigzag pattern in a width direction, on of the printing medium, and the receiving parts of the platen are arranged in a zigzag pattern to correspond to the zigzag pattern of the nozzle plates.

43. The apparatus of claim 32, further comprising:

a driving source to drive the platen, the wiper, and the cap member.

44. The apparatus of claim 32, further comprising:

a first driving source to drive the platen and the wiper; and a second driving source to drive the cap member, wherein the first and second driving sources are independent of each other.

45. An inkjet image forming apparatus, comprising:

an inkjet head including a nozzle unit having a length in a main scanning direction equal to or greater than a width of a printing medium, and a first reference part;

a cap member to cap the nozzle unit, the cap member including a second reference part to correspond to the first reference part of the inkjet head, the first reference parts coupling with the second reference part to cap the nozzle unit; and a platen facing the nozzle unit to form a delivery path with the nozzle unit and to support a backside of paper, wherein the platen moves between a printing position constituting the delivery path and a maintenance position spaced apart from the printing position such that when the platen is positioned at the maintenance position, the cap member accesses the nozzle unit, and a movement path of the platen between the printing position and the maintenance position comprises a parallel interval that is substantially parallel to the delivery path in which a gap between the platen and the nozzle unit remains constant and a sloped interval in which the, gap between the platen and the nozzle unit changes.

46. The apparatus of claim 45, further comprising:

a wiper to move in connection with the platen to wipe the nozzle unit, wherein the platen is located between the nozzle unit and at least one of the cap member and the wiper when the platen is positioned at the printing position.

47. A method of maintaining a nozzle unit of an inkjet image forming apparatus, the apparatus having an inkjet head including a nozzle unit having a length in a main scanning direction equal to or greater than a width of a printing medium, a platen facing the nozzle unit to support a backside of the printing medium to form a delivery path, a wiper to wipe the nozzle unit, and a cap member to cap the nozzle unit, the method comprising:

moving the platen such that the platen moves from a printing position forming the paper delivery path to a maintenance position to expose a lower portion of the nozzle unit to allow a wiping and a capping of the nozzle unit;

moving the wiper and the cap member from original positions thereof to wipe and cap the nozzle unit; and returning the wiper and the cap member to the original position thereof to allow printing, and moving the platen between the nozzle unit and at least one of the cap member and the wiper to position the platen at the printing position, wherein a movement path of the platen between the printing position and the maintenance position comprise a parallel interval that is substantially parallel to the delivery path in which a gap between the platen and nozzle unit remains constant and a sloped interval in which the gap between the platen and the nozzle unit changes.

48. The method of claim 47, wherein the platen, the wiper, and the cap member are simultaneously driven by a maintenance motor.

49. The method of claim 48, wherein the wiper is connected to the platen to wipe the nozzle unit during at least one of a time, period in which the platen moves from the printing position to the maintenance position and a time period in which the platen moves from the maintenance position to the printing position, and the wiper does not contact the nozzle unit during other processes, and the cap member caps the nozzle unit when the platen is positioned at the maintenance position.

50. The method of claim 47, wherein the wiper is connected to the platen to wipe the nozzle unit during at least one of a time period in which the platen moves from the printing position to the maintenance position and a time period in which the platen moves from the maintenance position to the printing position, and the wiper does not contact the nozzle unit during any other time period.

51. The method of claim 50, wherein the platen and the wiper are driven by a maintenance motor, and the cap member and a delivery unit to deliver the printing medium are driven by a drive motor.

52. The method of claim 47, wherein the wiper wipes the nozzle unit during a time period in which the platen moves from the printing position to the maintenance position and a time period in which the platen moves from the maintenance position to the printing position.

53. An inkjet image forming apparatus, comprising:

an inkjet head including a nozzle unit having a length in a main scanning direction equal to or greater than a width of a printing medium;

a wiper to wipe the nozzle unit; and a platen facing the nozzle unit to support a backside of the printing medium to form a delivery path, the platen being moveable between a printing position constituting the delivery path and a maintenance position at an opposite side of the nozzle unit with respect to the delivery path to allow the wiper to access the nozzle unit, wherein a movement path of the platen between the printing position and the maintenance position comprises a parallel interval that is substantially parallel to the delivery path in which a gap between the platen and the nozzle unit remains constant and sloped interval in which the gap between the platen and the nozzle unit changes.

54. The apparatus of claim 53, wherein the platen is located between the wiper and the nozzle unit when the platen is positioned at the printing position.

55. The apparatus of claim 53, wherein the wiper is connected with the platen to wipe the nozzle unit while the platen moves.

56. An inkjet image forming apparatus, comprising:

an inkjet head including a nozzle unit having a length in a main scanning direction equal to or greater than a width of a printing medium;

a cap member to cap the nozzle unit; and a platen facing the nozzle unit to support a backside of the printing medium to form a delivery path, the platen being moveable between a printing position constituting the delivery path and a maintenance position at an opposite side of the nozzle unit with respect to the delivery path to allow the cap member to access the nozzle unit, wherein a movement path of the platen between the printing position and the maintenance position comprises a parallel interval that is substantially parallel to delivery path in which a gap between the platen and the nozzle unit remains constant and a sloped interval in which the gap between the platen and the nozzle unit changes.

57. The apparatus of claim 56, wherein the platen is located between the cap member and the nozzle unit when the platen is positioned at the printing position.

58. The apparatus of claim 37, further comprising:

a wiper to wipe the nozzle unit, wherein the wiper, the cap member, and the platen are driven by the same driving source.

59. The apparatus of claim 57, further comprising:

a wiper to wipe the nozzle unit, wherein the cap member and the wiper are driven by separate and independent driving sources.

60. The apparatus of claim 56, wherein the cap member is connected with the platen and moves between a capping position and an uncapping position while the platen moves between the maintenance position and the printing position.

61. An inkjet image forming apparatus, comprising;

an inkjet head unit including a nozzle unit having a length in a main scanning direction equal to or greater than a width of a printing medium;

a platen moveable between a printing position to form a delivery path of the printing medium with the inkjet head unit and a non-printing position away from the printing position; and a maintenance unit having at least one of a wiper and a cap member to move between a rest position disposed opposite to the delivery path with respect to the printing position and a maintenance position corresponding to the printing position, wherein a movement path of the, platen between the printing position and the maintenance position comprises a parallel interval that is substantially parallel to the delivery path in which a gap between the platen and the nozzle unit remains constant and a sloped interval in which between the plate n and the nozzle unit changes.

62. The apparatus of claim 61, wherein when the platen is disposed in the printing position, the maintenance unit is disposed in the rest position opposite to the inkjet head unit with respect to the printing position of the platen.

63. The apparatus of claim 61, wherein when the platen is disposed in the non-printing position, one of the wiper and the cap member is disposed in the maintenance position and the other one of the wiper and the cap member is disposed in the rest position.

64. The apparatus of claim 61, further comprising:

a driving unit to move the platen and the maintenance unit.

65. The apparatus of claim 61, further comprising:

a driving unit;

a first arm connected to the driving unit to move the platen and one of the wiper and the cap member; and a second arm connected to the driving unit to move the other one of the wiper and the cap member.

66. The apparatus of claim 61, further comprising:

a housing having a groove;

a driving unit;

a first arm connected to the driving unit and the groove to move one of the wiper and the cap member; and a second arm connected to the driving unit to move the other on of the wiper and the cap member.

67. The apparatus of claim 61, further comprising:

a housing having a first groove and a second groove;

a driving unit;

a first arm connected to the driving unit and the first groove lo move the platen and one of the wiper and the cap member; and a second arm connected to the driving unit and the second groove to move the other one of the wiper and the cap member.

68. The apparatus of claim 61, wherein the cap member rotates between the maintenance position and the rest position with respect to a rotation axis disposed between the maintenance position and the rest position.

69. The apparatus of claim 61, wherein the at least one of the wiper and the cap member moves with respect to the platen when the platen moves between the printing position and the non-printing position.

70. The apparatus of claim 61, wherein the platen moves in a direction having an angle with the delivery path of the printing medium, and the at least one of the wiper and the cap member rotates in a direction with respect to the platen.

71. An inkjet image forming apparatus, comprising:

an inkjet head including a nozzle unit having a length in a main scanning direction equal to or greater than a width of a printing medium;

a maintenance unit having at least one of a wiper to wipe the nozzle unit and a cap member to cap the nozzle unit;

a platen facing the nozzle unit to support a backside of the printing medium, to form a delivery path with the nozzle unit, and to be moveable between a printing position forming the delivery path and a maintenance position to allow the maintenance unit to access the nozzle unit; and a discharge unit located at an exit side of the nozzle unit to discharge printed printing medium, wherein movement path of the platen between the printing position and the maintenance position comprises a parallel interval is substantially parallel to the delivery path in which a gap between the platen and the nozzle unit remains constant and a sloped interval in which the gap between the platen and the nozzle unit changes and the platen is disposed below the discharge unit in the maintenance position.

* * * * *